United States Patent [19]

Toti

[11] Patent Number: 4,858,668

[45] Date of Patent: Aug. 22, 1989

[54] VERTICAL WINDOW COVERING SYSTEMS

[76] Inventor: Andrew J. Toti, 311 W. River Rd., Modesto, Calif. 95351

[21] Appl. No.: 920,704

[22] Filed: Oct. 17, 1986

Related U.S. Application Data

[63] Continuation-in-part of Ser. No. 888,462, Jul. 18, 1986, abandoned, which is a continuation-in-part of Ser. No. 788,460, Oct. 17, 1985, abandoned.

[51] Int. Cl.[4] ..... E06B 3/94

[52] U.S. Cl. ..... 160/84.1; 160/330

[58] Field of Search ..... 160/84 R, 84 H, 84 V, 160/166 A, 196 R, 196 D, 230, 330, 201, 206, 345, 347, 126

[56] References Cited

U.S. PATENT DOCUMENTS

| | | | |
|---|---|---|---|
| 1,168,343 | 1/1916 | Smith | 160/84 R |
| 2,231,305 | 3/1941 | Vallen . | |
| 2,293,883 | 2/1942 | Bossert . | |
| 2,732,894 | 3/1956 | Harris . | |
| 2,754,901 | 7/1956 | Madsen | 160/84 H |
| 3,116,784 | 1/1964 | Dwyer . | |
| 3,242,972 | 3/1966 | Truesdale | 160/84 R |
| 3,275,065 | 4/1963 | Maras . | |
| 3,369,589 | 2/1968 | Benkert, Jr. | 160/84 R |
| 3,382,507 | 6/1968 | Micheau . | |
| 3,730,249 | 5/1973 | Hess . | |
| 3,774,666 | 11/1973 | Bunger . | |
| 4,424,849 | 1/1984 | Robertson | 160/84 R X |
| 4,493,358 | 1/1985 | Jacobson . | |
| 4,582,109 | 4/1986 | Fairbanks | 160/84 R |

FOREIGN PATENT DOCUMENTS

| | | | |
|---|---|---|---|
| 723769 | 3/1942 | | |
| 56179 | 8/1891 | Fed. Rep. of Germany . | |
| 2530803 | 9/1975 | Fed. Rep. of Germany . | |
| 719050 | 11/1954 | United Kingdom | 160/168 |
| 1554159 | 10/1975 | United Kingdom . | |

*Primary Examiner*—Blair M. Johnson

*Attorney, Agent, or Firm*—Philip A. Dalton

[57] ABSTRACT

A vertical window covering system which utilizes an area of prepleated drapery fabric having permanently set pleats of a nature such that the fabric behaves like a tension spring tending to bias pleats toward the folded state or a vertical blind with taped or string ladders. The drape is hung from a traverse track adapted to be mounted in a horizontal orientation. A plurality of track mounting arrangements are provided for mounting a plurality of spaced pleats of the fabric intermediate left and right edge pleats thereof for bidirectional traverse relative to the traverse track. First and second drape edge carrier components are mounted to the traverse track with at least one of the carrier arrangements adapted for bidirectional traverse on the track. Drape edge stabilizer arrangements are mounted on each of the carrier arrangements for holding the edge pleats in a substantially true vertical orientation when the drapery fabric is traversed to an open pleat condition, i.e. the drape is closed over whatever structure it is covering. The intermediate pleats are stabilized in true vertical position by thin metal or plastic slats mounted to the intermediate pleats and carried on the pleat hanging arrangement mounting the drape to the traverse track. Preferably a traverse alignment arrangement using tensioned guide cords extending through apertures in each pleat gives pleat alignment during drape traverse.

32 Claims, 11 Drawing Sheets

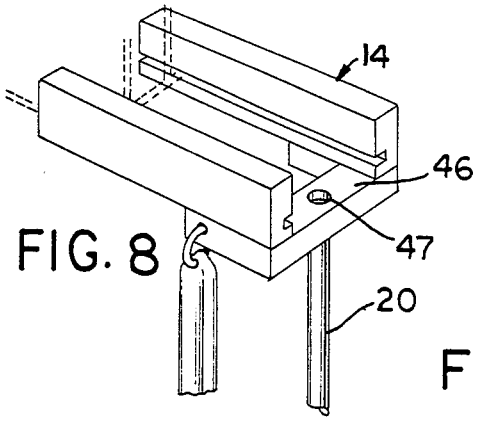
FIG. 8
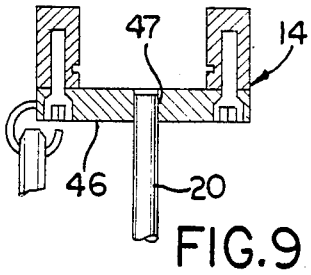
FIG. 9
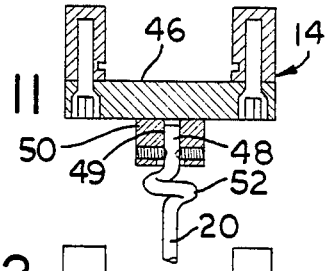
FIG. 11
FIG. 12
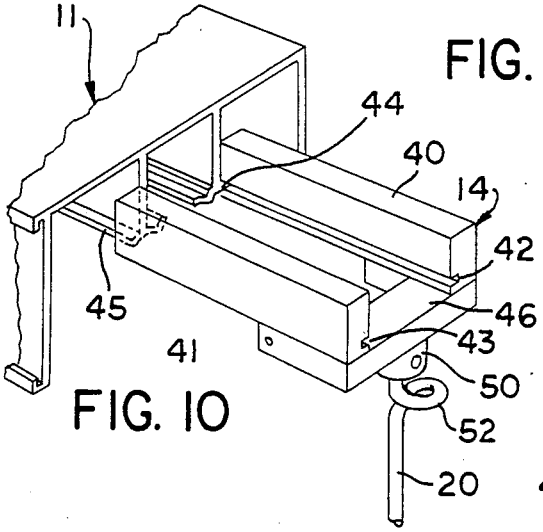
FIG. 10
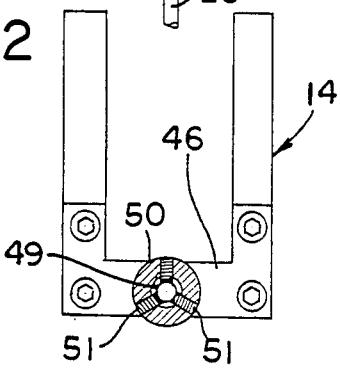
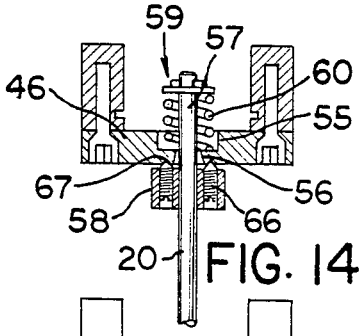
FIG. 14
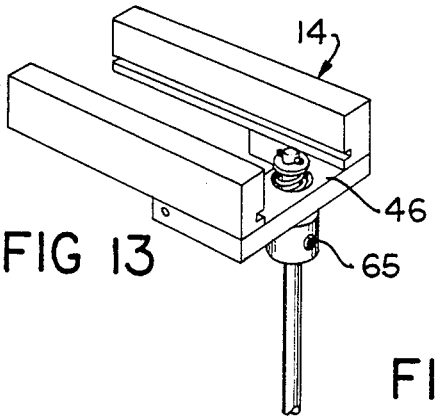
FIG 13
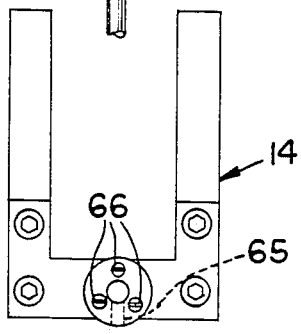
FIG. 15

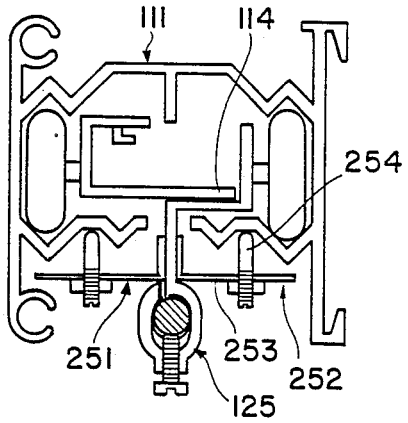
FIG. 31
FIG. 32
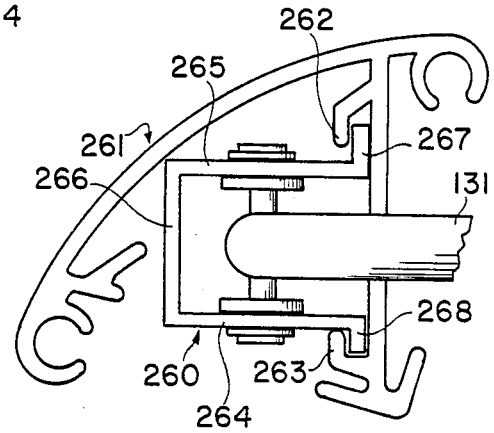
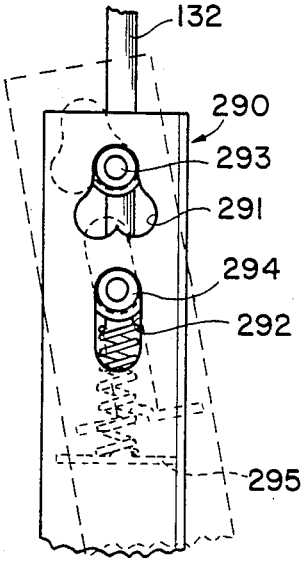
FIG. 37
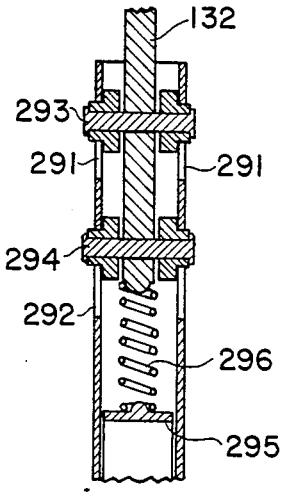
FIG. 38

VERTICAL WINDOW COVERING SYSTEMS

This application is a continuation-in-part my copending application Ser. No. 888,462, now abandoned, filed July 18, 1986, and entitled "Vertical Window Covering System," which is a continuation-in-part of my application Ser. No. 788,460, now abandoned, filed Oct. 17, 1985, and entitled "Vertical Drape System."

This invention relates generally to window covering systems and, more specifically, to window covering systems in which the sections of the window covering are disposed vertically. This invention specifically relates to a vertical drape system using prepleated material and to a vertical blind system using string ladders to maintain blind slat position. The term "window" is used as a convenient reference with the understanding that the invention could be used as a door covering as well.

Over the past several years, pleated shade systems have become a popular form of window treatment. One version of a pleated shade system available from Verosol USA, Inc. of Pittsburgh, Pa., utilizes a prepleated fabric with strong, permanently set pleats which pack very tightly. The Verosol fabric pleats are single pleats. Another version of prepleated fabric is a dual pleated fabric recently introduced by the Window Fashion Division of Hunter Douglas, Inc. of Broomfield, Colo., under the trademark DUETTE TM.

These pleated fabrics work very well in pleated shade systems because the pleats run horizontally and the regularity of the pleating is controlled by the weight of a board or other length of rigid material fastened to the bottom edge of the area of pleated fabric. There has been a desire on the part of the industry to use these prepleated fabrics for vertical drape systems as well, but the problems in adapting the material for vertical drapes have thus far not been solved in the prior art. These problems have prevented the application from being realized.

The main problem with use of the prepleated material is providing uniform hanging of the pleats when the material is disposed vertically. Because of the strongly set pleats, the material tends to behave like a tension spring. The pleats have a spring force bias toward the packed-together state of the fabric. When used in a vertical drape, this spring force makes the material hang with uneven draping when the drape is closed (i.e. the open state of the pleated fabric) because the bottom portion of the material which is not mechanically constrained in position tends to draw together. Thus the pleats do not hang straight and the appearance is unacceptable.

An additional problem occurs when the drape is being traversed open after being left in a closed position for a length of time. The pleats of the drape do not always pack consistently and tend to distort out of the plane of traverse of the drape. This makes it difficult to obtain a uniform pleating of the drape as it closes and requires hand adjustment of the individual pleats of the fabric.

Vertical blind systems are also popular window coverings and share some of the same problems. It would be preferable to use the same string ladder spacing and confining system in a vertical blind that is used in horizontal blind. However, if a string ladder is used, the weight of the ladder itself tends to distort the shape of the overall blind, especially at the edges where the bottom portions of the edge slats tend to be pulled inward. Furthermore, when the vertical blind is traversed from a closed to an open position, the slats tend to distort out of the plane of traverse due to unevenness in the folding of the string ladder material between slats.

It is the principal object of this invention to provide an improved vertical window covering system.

It is another object of this invention to provide a vertical drape system using a prepleated fabric with improved feature for maintaining quality appearance and operation of the drape system.

It is another object of this invention to provide a vertical blind system using string ladders on the blind slats with improved features for maintaining quality appearance and operation of the vertical blind system.

One aspect of this invention features a vertical window covering system which utilizes a window covering material portion having a plurality of sections disposed in a generally vertical orientation and being adaptable to being traversed between open and closed positions. This material portion may be either a vertical drape of the prepleated fabric type or a vertical blind arrangement using string ladders. Each has an inherent distortion characteristic causing non-vertical hanging of left and right edge portions thereof in a open or partially open state of the material portion. Note that the "open" state of the material portion, e.g. when the pleats of the drape are open, is the "closed" position of the overall window covering. A traverse track is adapted to be mounted in a horizontal orientation and a plurality of track mounting means are provided for mounting a plurality of sections of said window covering material intermediate said left and right edge portions thereof for bidirectional traverse relative to said traverse track. First and second edge carrier means are mounted to said traverse track with at least one of said carrier means being adapted for bidirectional traverse on said track. An edge stabilizer arrangement is mounted on each of said carrier means for holding said edge portions of said window covering material in a substantially straight vertical orientation when said material is traversed toward an open condition. This arrangement includes a stabilizer rod arrangement mounted to said carrier means in an accurate vertical orientation and with a degree of rigidity sufficient to overcome said inherent distortion characteristic. The stabilizer rod arrangement extends at least substantially the entire length of an associated one of said edge portions of said window covering material and is secured thereto at least at a plurality of locations throughout that length.

This invention also features an arrangement for solving the problems occurring when the window covering material portion includes a plurality of vertical material portions which move together as said material portion is traversed toward a closed state and have the further inherent distortion characteristic operating during traversing toward said open position tending to cause said vertical material portions to become misaligned in a direction perpendicular to the general plane of traverse. This arrangement includes a traverse alignment mechanism for maintaining the alignment of said vertical material portions during said traverse toward said closed state. The traverse alignment mechanism includes guide apertures formed in said vertical material portions at a prearranged position near a bottom edge thereof, a guide cord extending through said said guide apertures and being fastened to a first one of the stabilizer rod means, and a tensioning arrangement operatively mounted to a second of the stabilizer rods for maintaining said guide cord in substantial tension throughout the traverse of said material portion between said open and closed state.

In the case where both carriers are adapted to traverse the track, it is preferable to provide a traverse alignment mechanism which employs two separate guide cords and tensioning arrangements. If the carriers are in the form of relatively freewheeling carriages, then it is preferable to provide braking arrangements between the carriages and the traverse track to hold the carriages in selected positions against the forces exerted by the tensioning arrangements. The tensioning arrangements may comprise pulley and weight arrangements. Preferably the stabilizer rods comprise housings formed by two wall sections and the weight is confined to move in a vertical channel within the defined housing.

Utilizing the system of this invention, both edge pleats of the prepleated fabric are held in a true vertical orientation under all conditions of traverse of the drape material, including when the drape is in the fully closed condition with all of the pleats spread ("open" state of the fabric) to the maximum extent. This solves the major problem with adapting the prepleated fabric to use in a vertical drape system.

In accordance with one embodiment of this invention, it is also preferable to stabilize the position of a number of spaced intermediate pleats and this is most conveniently done with the intermediate pleats that are used to hang the drape on the traverse track. Thus the system of this invention further comprises pleat position stabilizing arrangements mounted to each of the plurality of spaced intermediate pleats for stabilizing the pleats in a vertical orientation. This stabilizing arrangement may, in some cases, simply comprise a weight fastened to a bottom portion of an associated pleat to bias the pleat to hang vertically. However, its is preferable in most instances to utilize an elongated thin slat fastened to the pleat and extending at least substantially the entire length thereof. The slat is preferably carried on the track mounting arrangements associated with the pleat. The slat may be combined with a weight mounted as a shoe at the bottom of the slat to increase the vertical position stability if needed or desired.

In one embodiment the stabilizer rod arrangements for holding the edge pleats vertical preferably include an integral spring flexure portion near a top end thereof adapted to respond to a sidewise force applied toward the bottom portion thereof of a magnitude substantially greater than the spring force of the drapery fabric by flexing and then restoring the stabilizer rod arrangements to an accurate vertical orientation. This is a safety feature which prevents permanent distortion of the stabilizer rod if, for example, someone pushes it sideways to look out the window without opening the drape.

It is preferred that this invention be implemented in a form in which the drape edge carrier components and the drape edge stabilizer arrangements together comprise a modular unit. In one embodiment, each of the drape edge carrier arrangements defines a horizontal mounting platform for the drape edge stabilizer arrangements. The modular unit includes stabilizer rod mounting arrangements for mounting the stabilizer rod to the mounting platform in an adjustable vertical position and an adjustable angular orientation relative to the mounting platform to enable precise adjustment of the stabilizer rod to extend perpendicular to the mounting platform.

The stabilizer rod mounting arrangement may take various forms. One embodiment uses a spring mounting assembly to respond to a sideways deflecting force and to bias the stabilizer rod to return to the vertical position. The stabilizer rod includes an upper rod end having a regular cylindrical shape. An aperture is provided in the mounting platform and has a tapered wall portion adapted to receive the upper rod end in a variable angular orientation. A mounting collar is fastened over the upper rod end on one side of the mounting platform. A compression spring is carried over the upper rod end on the other side of the mounting platform. A spring retaining bracket is mounted to the upper rod end to compress the spring between a wall surface of the mounting platform and the retaining bracket. The mounting collar includes a first adjustment arrangement for adjustably positioning the mounting collar on the upper rod end and a second adjustment arrangement for defining an adjustable angular contact relationship between the mounting collar and the mounting platform to establish an initial angular orientation for the mounting collar and the upper rod end. The upper rod end and the collar are deflectable away from the initial orientation and are biased by the compression spring to return to the initial orientation.

In this embodiment the mounting collar has a central aperture receiving the upper rod end and the first adjustment arrangement comprises a horizontally disposed set screw extending between an outer wall and the aperture for fastening the collar on the upper rod end in an adjustable position. The second adjustment arrangement comprises a triangular arrangement of set screws extending through the collar parallel to the aperture with screw tips contacting an adjacent surface of the mounting platform to jointly provide the adjustable angular contact relationship between the mounting collar and the mounting platform. Preferably the surface of the mounting platform of the carrier has indented regions formed therein that the tips of the three set screws are received in to establish a fixed radial orientation for the stabilizer rod to return to after deflection.

It will thus be appreciated that the vertical drape system of this invention solves all of the problems that are otherwise associated with use of the prepleated material in a vertical orientation. The invention is adaptable to use with all forms of drape traversing systems and will provide another visually attractive drape alternative to the window treatment industry.

It should also be appreciated that the system of this invention also solves all of the problems otherwise associated with use of a vertical blind system with string ladders for maintaining alignment of the blind slats. Thus the invention opens new possibilities for attractive and functional vertical blind systems.

Other objects, features and advantages of this invention will be apparent from a consideration of the detailed description given below in conjunction with the accompanying drawings.

FIG. 8 is a perspective view of a drape edge carrier and drape edge stabilizer arrangement in accordance with one embodiment of this invention.

FIG. 9 is a section view illustrating mounting arrangements employed in the embodiment of FIG. 8.

FIG. 10 is a perspective view of a drape edge carrier and drape edge stabilizer arrangement in accordance with an alternative embodiment of this invention.

FIG. 11 is a sectioned end view and FIG. 12 is a partially sectioned bottom view of mounting arrangements for the drape edge stabilizer arrangement of the embodiment illustrated in FIG. 10.

FIG. 13 is a perspective view of another embodiment of a drape edge carrier and drape edge stabilizer arrangement in accordance with this invention.

FIGS. 14 and 15 are, respectively, partly sectioned end and bottom views of the embodiment shown in FIG. 13.

FIG. 31 is a sectioned view of a traverse track and carriage assembly having an alternative carriage braking arrangement.

FIGS. 32–35 illustrate a mounting arrangement for a vertical stabilizer rod assembly with a rotational detented safety release arrangement.

FIGS. 37 and 38 illustrate an alternative embodiment of a mounting arrangement for a vertical stabilizer rod assembly with a rotational detented safety release feature.

FIGS. 1–16 illustrate one embodiment of this invention with variations on stabilizer rod mounting arrangements which provides useful operation for a vertical drape system utilizing an area of prepleated fabric under certain conditions of window covering size and arrangement. FIGS. 17–30 illustrate a second embodiment of this invention which can be adapted for all sizes of vertical blind system utilizing fabric tape or string ladder arrangements to maintain the vertical blind slats in aligned positions. FIGS. 32–36 illustrate a third embodiment of this invention having some aspects in common with the second embodiment. FIGS. 37 and 38 illustrate a variation of the third embodiment. FIGS. 37 and 38 illustrate a variation of the third embodiment. The embodiment of FIGS. 1–16 will be described first, followed by the vertical drape and vertical blind embodiments of FIGS. 17–30 and FIGS. 32–38.

Figure 1:
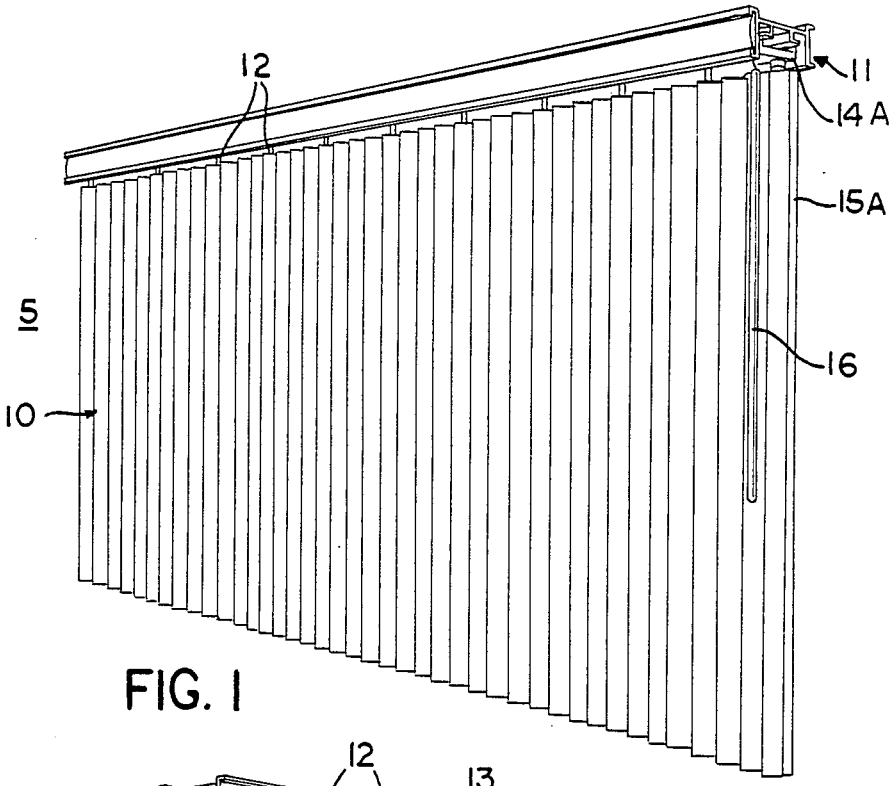
FIG. 1 is a front perspective view of a vertical drape system incorporating the pleat stabilizing features of one embodiment of this invention.
Figure 2:
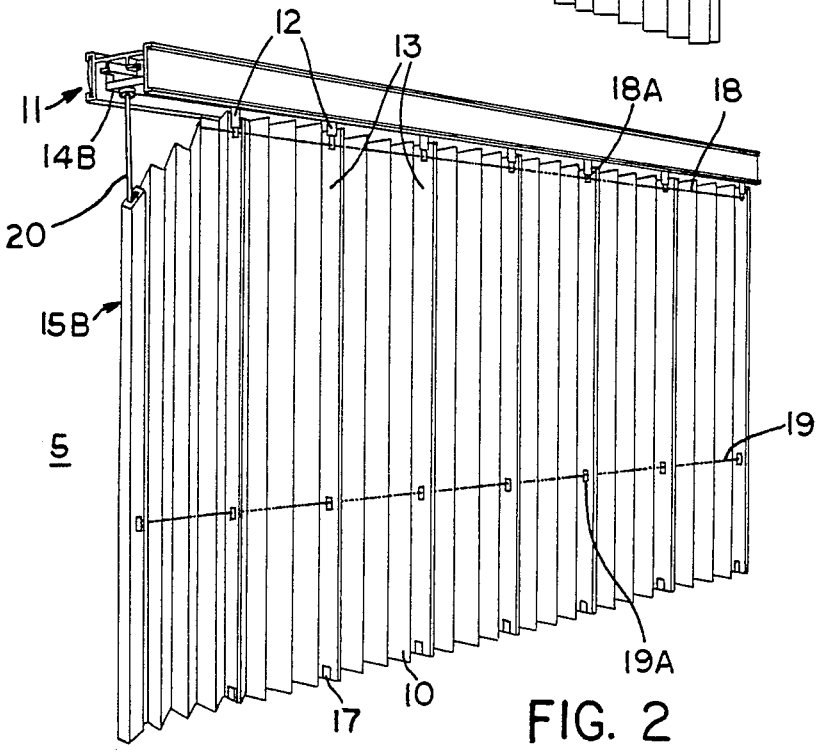
FIG. 2 is a rear perspective view of a vertical drape system incorporating the features of one embodiment of this invention.

Referring to FIGS. 1 and 2, vertical drape system 5 utilizes an area of prepleated fabric 10 having permanently set pleats of the type described above. A traverse track arrangement 11 is adapted to be mounted in a horizontal orientation with a plurality of track mounting means 12 which mount a plurality of spaced pleats of the fabric intermediate left and right edge pleats thereof for bidirectional traverse relative to the traverse track 11. A drape edge carrier 14 is provided for carrying a drape edge stabilizer arrangement 15 associated with a right edge pleat of the drape 10. Another drape edge carrier and associated drape edge stabilizer arrangement (not shown) are provided for the left edge pleat.

As will be discussed below, at least one of the drape edge carrier arrangements is mounted on the traverse track for bidirectional traverse. The other edge carrier means may be mounted in a stationary position or may also be mounted for bidirectional traverse on the traverse track arrangement. Each of the drape edge stabilizer means 15 are constructed and arranged to hold the edge pleats of the fabric in a substantially true vertical orientation when the drapery fabric is traversed open to overcome the spring forces of the prepleated fabric and maintain an attractive true vertical edge.

Each of the drape edge stabilizer means includes a stabilizer rod 20 which extends at least substantially the entire length of an associated edge pleat and is secured to that edge pleat substantially throughout its length. Preferably this securing of the edge pleat to the stabilizer rod provides for captive positioning of the pleat vertically on the stabilizer rod but permits rotational movement of the pleat relative to the stabilizer rod. It is preferable that the overall arrangement for mounting the stabilizer rod 20 to the edge pleat also provide a finished looking edge on the edge pleat for good appearance of the overall drape.

To stabilize the position of the intermediate pleats which are mounted for traverse in the traverse track utilizing the mounting arrangements 12, pleat position stabilizing means 13 are mounted to each of the spaced intermediate pleats. These pleat position stabilizing means may take various forms. In a short drape, the pleat position stabilizing means may simply comprise a weight 17 mounted to a bottom portion of an associated pleat to bias that pleat to hang vertically. With each of the intermediate pleats so biased, there will be a regular appearance to the spacing of the pleats in the drape when the drape is partially or completely traversed to a closed drape position.

Another approach to pleat position stabilizing means involves utilizing an elongated thin slat, such as the slats 13 shown mounted to the intermediate pleats, extending at least substantially the entire length of the pleat. This thin slat may be made from a flat metal sheet such as, for example, a slightly coved thin venetian blind slat. This slat may be mounted to the associated pleat utilizing any appropriate adhesive means such as a double sided sticky tape. Alternatively, a thin plastic slat could be mounted to the intermediate pleats for stabilization purposes. If added weight for stabilization is required a lead weight may be fastened to a bottom portion of the plastic or metal strip to provide additional weight biasing of the intermediate pleats into a true vertical orientation. The spacing between stabilized intermediate pleats is determined by the spring force in the prepleated material.

Any convenient traversing arrangement can be employed with the drape system of this invention for driving the traversing drape edge carriers in either a manual or motorized fashion. As shown in FIG. 1 a hand operated baton 16 is attached to the carrier 14 to enable that carrier to be manually pulled for opening and closing the drape. Any of the well-known alternative traversing arrangements utilizing cords and pulleys could also be provided for use with the vertical drape system of this invention.

As shown in FIG. 2, in arrangement of upper chains 18 and lower chains 19, mounted in a suitable manner at points 18A and 19B to intermediate pleat stabilizing arrangements, may be employed. This is a relatively standard approach for assuring that, in a long drape, the pulling force on the intermediate stabilized pleats will be uniform as the drape is traversed from a open to a fully closed position. This also avoids putting to much stress on the prepleated drape sections which might tend over time to stretch certain portions of the drape.

Figure 3:
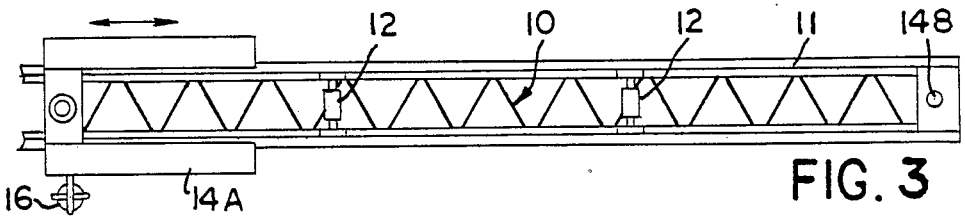
FIGS. 3–5 are schematic top view depicting several versions of drape traversing arrangements which may be utilized with this invention.
Figure 4:
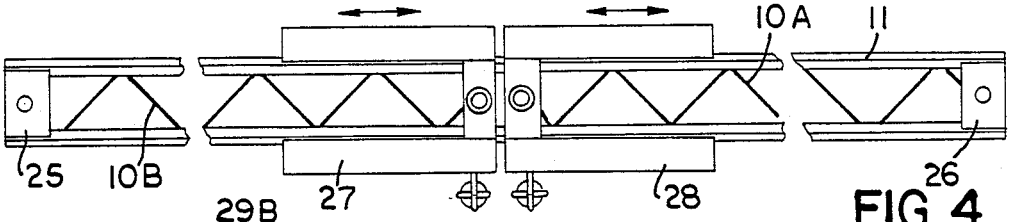
Figure 5:
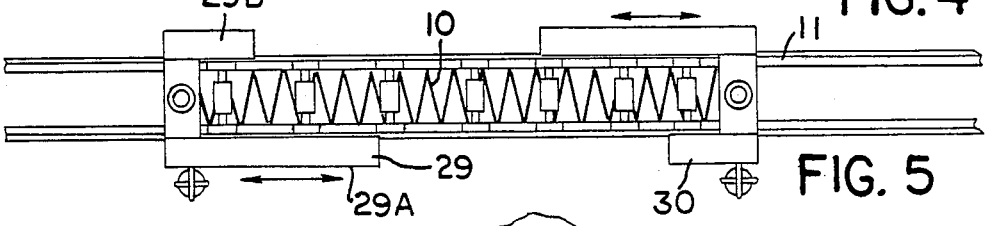

FIGS. 3, 4 and 5 illustrate the various approaches that can be taken to providing for single or dual drape sections with single or dual traversing of each drape section. FIG. 3 shows a single traversing drape with drape edge carrier 14B mounted in a fixed position at one end of the traverse track 11 and with drape edge carrier 14A mounted for bidirectional traverse as shown.

In the FIG. 4 version there are two separate drape sections 10A and 10B. The left edge carrier 25 associated with drape 10B is mounted in a fixed position and the right drape edge carriers 26 is mounted in a fixed position at the right side of the traverse track 11. Edge carriers 27 and 28 are each mounted for bidirectional traverse and carry associated edges of the drapes sections 10A and 10B with them.

FIG. 5 shows a mounting arrangement in which two traversing edge carriers 29 and 30 are mounted for bidirectional traverse on each end of a single drape 10. This permits the single drape 10 to be positioned in a drape-open position at any location along the traverse track 11. For example, it can be placed at the left edge, the right edge or at the center of the track. It should be noted that carrier 29, for example, has two separate side guide sections 29A and 29B. Carrier 30 is identical but reversed in position. This structure and arrangement of the carriers 29 and 30 permits very close nesting of the two carriers when drape 10 is open without requiring that two separate types of carriers be employed. While each of the arrangements depicted in FIGS. 3–5 show the use of a manually operated baton 16, knowledgeable persons in the vertical drape art will readily appreciate how the various drape edge carriers depicted can be mounted to cord and pulley arrangements. Thus such cord and pulley arrangement need not be depicted or disclosed herein.

Figure 6:
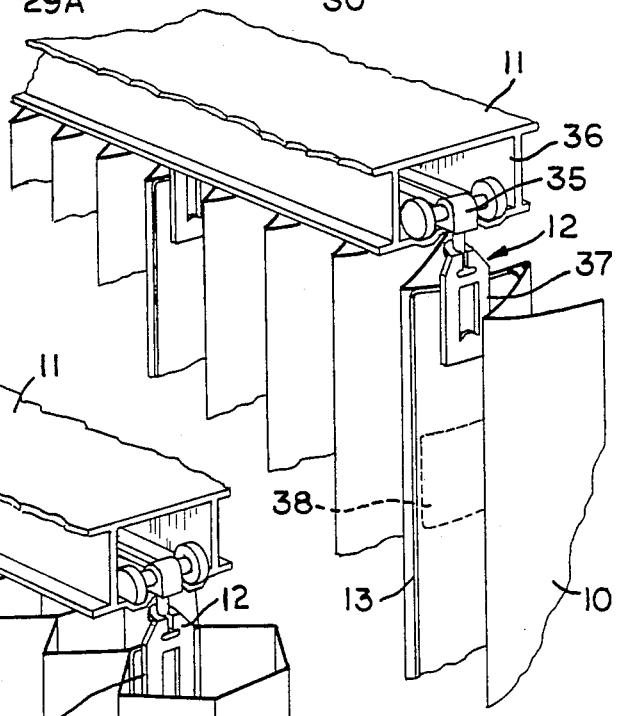
FIGS. 6 and 7 are partial perspective views showing hanging and stabilizing arrangements for intermediate pleats in accordance with this invention.
Figure 7:
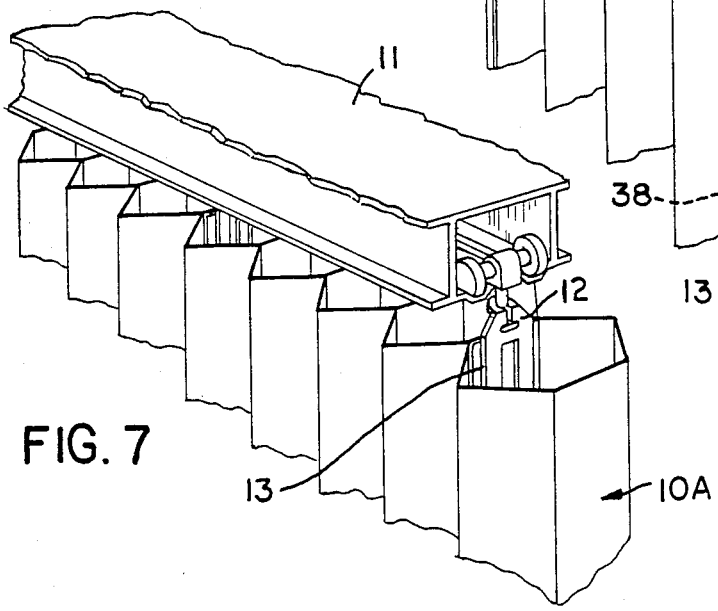

Referring to FIGS. 6 and 7, details of the track mounting arrangements 12 for carrying intermediate pleats of the drape will be described. The track mounting arrangement 12 includes a roller carriage portion 35 which travels in a pair of tracks in the generally C-shaped traverse track 36 which has an open bottom slot. Hanger portion 37 extends vertically from the carriage 35 and attaches to the stabilizing strip 13. The hanger portion 37 is mounted for rotation relative to the carriage 35. The stabilizing strip 13 may be mounted to the associated pleat of the drape fabric 10 by a suitable adhesive designated 38. This adhesive may, for example, be a double sided adhesive tape of the type capable of permanently securing the stabilizing strip 13 to the fabric pleat. Several sections of tape may be used as necessary. The FIG. 6 embodiment utilizes a single pleat fabric of the type available from Verosol USA.

FIG. 7 illustrates the track mounting arrangement 12 applied to a double pleat fabric 10A of the type available from Hunter Douglas. In this case, the stabilizing strip 13 is mounted to a transverse section of the stabilized intermediate pleat. In all other respects, the mounting arrangement for bidirectional traverse of the intermediate pleats is the same as in the FIG. 6 embodiment.

FIGS. 8–15 illustrate three separate embodiments of the modular combination of a carrier component which mounts on the traverse track externally and three forms of drape edge stabilizer arrangements. It should be understood that the drape edge stabilizer arrangements shown in FIGS. 8–15 could also be mounted to a fixed drape edge carrier, that is, one which is fixed in position on the inside of the traverse track. It should also be understood that the drape edge stabilizer arrangements could be mounted on drape edge carrier components which are adapted to be received within the traverse track rather than riding on the outside of the track. The use of a carrier arrangement riding on the outside of the traverse track provides additional stability for the drape edge stabilizer arrangement mounted thereto.

The structure and arrangement of the carrier 14 will be described first with reference to FIG. 10. The left and right guide portions 40 and 41 have internal grooves 42 and 43 which receive the lips 44 and 45 on the central C-shape portion of the traverse track 11. The side guides 40 and 41 may take any of the shapes depicted in FIGS. 3–5, but preferably have at least one side having a length of at least about two inches to provide good tracking stability for the carrier.

The carrier defines a horizontal mounting platform 46 to which the various drape edge stabilizer arrangements are mounted. In the arrangement depicted in FIGS. 8 and 9 stabilizer rod 20 is secured directly in an aperture 47 in the platform 46. Since it is important that the stabilizing rod 20 be mounted precisely perpendicular to the mounting platform 46 for true vertical hanging of the stabilizer rod, this mounting arrangement would preferably be accomplished by very accurate formation of the aperture 47 and very tight tolerance mounting of the stabilizer rod 20 therein with good jigging and fixturing to achieve highly accurate positioning. The type of accuracy which is desirable for this invention may be difficult to achieve in practice at reasonable cost using the embodiment shown in FIGS. 8 and 9. Thus the embodiments shown in FIGS. 10–15 provide for appropriate adjustable mounting of the stabilizer rod relative to the mounting platform.

Referring now to FIGS. 10–12, it can be seen that, in this second embodiment, the upper cylindrical rod portion 48 of the stabilizer rod 20 is received in a tapered aperture 49 formed in a cylindrical mounting bracket 50 which is rigidly fixed to the mounting platform 46. An arrangement of three set screws 51, disposed in a triangulated fashion through the walls of the bracket 50, provide for position adjustment of the stabilizer rod 20.

Vertical adjustment of the stabilizer rod 20 can be readily accomplished by controlling how far the upper rod end 48 is inserted in the aperture 49. By adjusting the sets screws 51, the projecting angle of the stabilizing rod 20 can readily be adjusted until it is disposed precisely vertical to the mounting platform 46. As shown in FIGS. 10 and 11, immediately beneath the upper rod end 48 of the stabilizer rod 20 is formed a single spring coil turn 52. This spring flexure portion 52 may have other spring coil turns if necessary or desired to achieve a particular spring flexure characteristic. The spring flexure characteristic desired is one which enables the stabilizer rod 20 to respond to a sidewise force applied to the rod below the spring flexure portion 52 by flexing out of a true vertical position and then restoring to the true vertical orientation after the deflecting force is removed.

It should be appreciated that this same spring flexure portion for the stabilizing rod 20 could be applied in the embodiment shown in FIGS. 8 and 9. Providing this spring flexure in the edge pleat stabilizing means permits the edge of the drape to be pushed out of position without destroying the desired vertical orientation of stabilization of the edge pleat of the drape. It is a common occurrence for the edge of the drape to be pushed aside in order to see beyond the drape. This spring flexure feature of the invention permits this to occur without losing the function of the edge pleat stabilization. Without it, the stabilizing rod might be distorted or bent and result in an unacceptable edge pleat draping.

FIGS. 13–14 illustrate one embodiment of the feature of the invention incorporating a modular drape edge carrier and edge pleat stabilizer arrangement. In this embodiment, the mounting platform 46 has an aperture 55 formed therein which includes a tapered portion 56. This tapered portion 56 receives the upper cylindrical rod end 57 of stabilizer rod 20 and permits stabilizer rod 20 to assume a range of different angular orientations relative to the mounting platform 46. A mounting collar 58 is fastened to the stabilizer rod 20 on the underside of the mounting platform 46. A spring retaining bracket arrangement 59 comprising a washer and cotter pin is fastened to the upper rod end 57 of the stabilize rod 20 and captures a compression spring 60 between it and a recessed wall surface of the mounting platform 46 in the aperture 55. The combination of the mounting collar 58, the spring retaining bracket 59, and the compression spring 60 mount the stabilizing rod 20 relative to the mounting platform 46 with spring flexure in the vertical orientation of the stabilizing rod 20 and with restoring force by the spring 60 to the initial rod position.

Adjustment of the vertical position of the stabilizing rod 20 relative to the mounting platform 46 is accomplished utilizing the set screw 65 extending horizontally within the mounting collar 58. The angular orientation of the mounting collar 58 relative to the mounting platform 46 is controlled by a triangular arrangement of set screws 66. By adjusting the set screws 66, a straight up and down orientation of the stabilizer rod 20 relative to the mounting platform 46 can be readily achieved. The tips of the set screws 66 are preferably received in slight indentations 67 formed in the bottom wall of the mounting platform 46. Utilizing this approach, any pushing of the stabilizer rod 20 out of its normal vertical orientation will maintain at least one of the set screw tips 67 in its associated indentation and tend to return the mounting collar 58 to a preset position relative to the mounting platform 46.

It will thus be appreciated that the arrangement depicted in FIGS. 13–15 includes a first adjustment means 65 for adjustable positioning the mounting collar on the upper rod end, thus determining the vertical position of the stabilizer rod 20. The arrangement also includes a second adjustment means in the form of the set screws 66 for defining an adjustable angular contact relationship between the mounting collar and the mounting platform and thus to establish an initial angular orientation for the mounting collar and the stabilizing rod 20 captivated therein.

It will be readily appreciated by persons of ordinary skill that the arrangement of the mounting collar 58 the spring retaining bracket arrangement 59 and the spring 60 could be reversed. That is, the spring 60 could be captivated between the bottom wall of the mounting platform 64 and a spring retaining bracket mounted to the stabilizer rod 20 below the mounting platform 46. The adjustment collar 58 would then be positioned above the mounting platform but otherwise serve the same function. This alternative arrangement is not as advantageous as the one depicted in FIGS. 13–15 since it places the angular position adjusting arrangement at a location which is not readily accessible if any minor adjustment of the angle is required after the vertical drape system is mounted in position.

Figure 16:
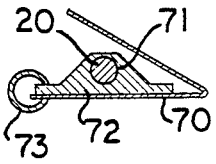
FIG. 16 is a section view illustrating one embodiment of an approach for fastening a stabilizer rod to a drapery edge pleat in accordance with this invention.

FIG. 16 illustrates one approach for mounting the stabilizing rod 20 to an edge pleat 70. Preferably the stabilizing rod 20 is captivated in a channel 71 which extends the length of an elongated mounting strip 72 having a front face adhesively mounted to the surface of the edge pleat 70. An edge finishing strip 73 is mounted over the edge of pleat 70 and the mounting strip 72 to provide a finished appearance. If desired th edge strip 73 could be made integral with the mounting strip 72. Various forms of mounting strip 72 could be provided. For example, the mounting strip could be arranged to sandwich the edge pleat 70 between front and back portions. It is preferable that the stabilizer rod 20 be free to rotate with respect to the mounting strip 72 so that the angular position of the edge pleats 70 can be altered as the drape is traversed between open and closed positions.

Figure 17:
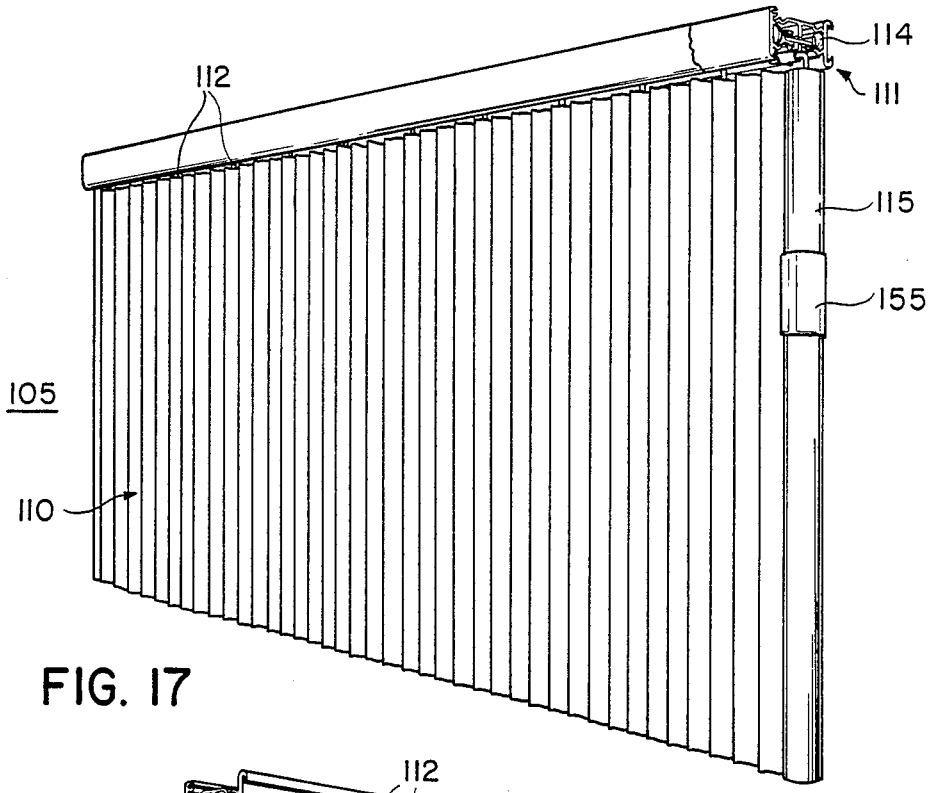
FIG. 17 is a front perspective view of a vertical drape system incorporating the stabilizing features of a presently preferred embodiment of this invention.
Figure 18:
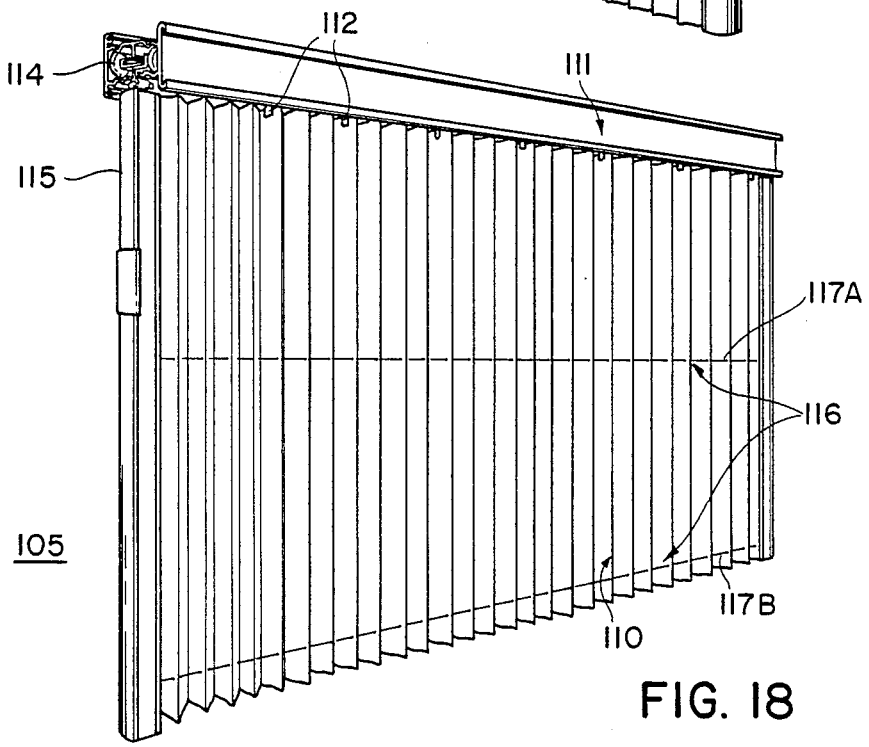
FIG. 18 is a rear perspective view of a vertical drape system incorporating the features of a preferred embodiment of this invention.
Figure 28:
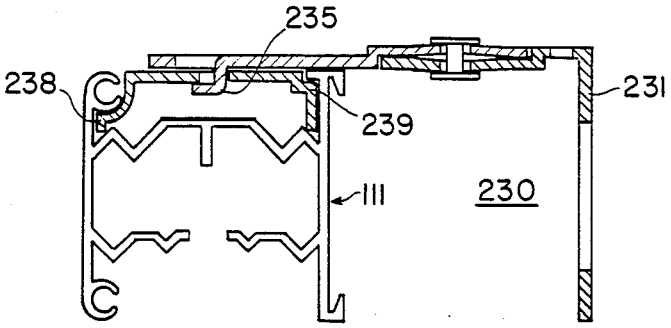
FIGS. 28–30 illustrate a preferred traverse track bracket mounting arrangement in accordance with this invention.
Figure 29:
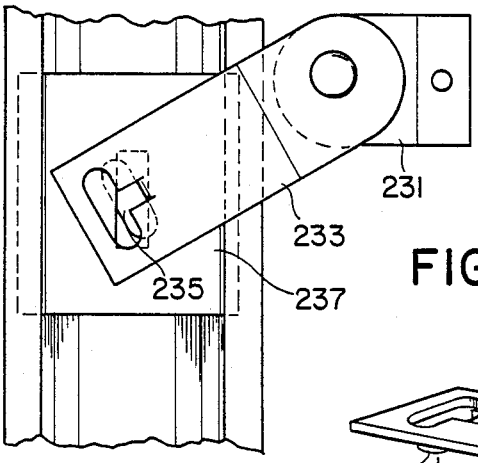
Figure 30:
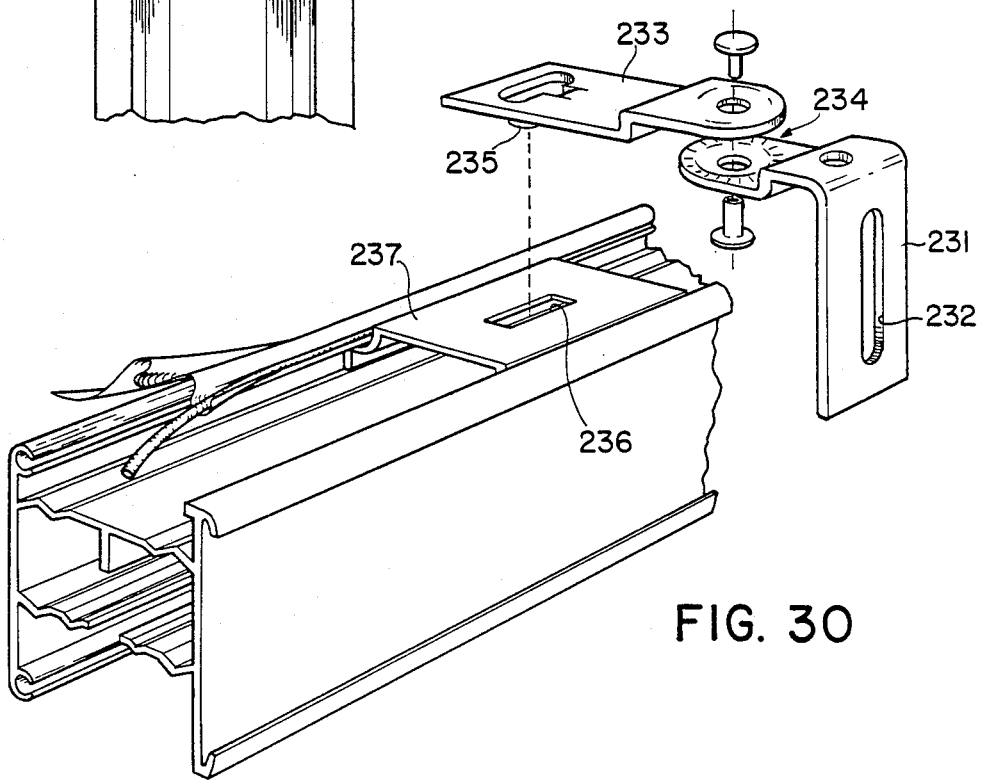

Referring now to FIGS. 17 and 18, vertical drape system 105 utilizes an area of prepleated fabric 110 having permanently set pleats as previously described. A traverse track arrangement 111 is adapted to be mounted in a horizontal orientation above a window or sliding patio door or the like. One type of mounting bracket arrangement is shown in FIGS. 28–30 and will be described below. The traverse track arrangement carries a plurality of track mounting means 112, each of which is fastened to one of the spaced pleats of the fabric area 110 intermediate the left and right edge pleats thereof for bidirectional traverse of these pleat sections relative to the traverse track. A carrier 114, in this case in the form of a carriage arrangement more particularly shown in FIGS. 19–21, carries an edge stabilizer arrangement in the form of stabilizer rod 115. Edge carrier 114 and stabilizer rod 115 are provided on each edge of the drape arrangement 105. In the example shown in FIGS. 17 and 18, both carriers 114 are arranged for movement on the traverse track 111 so that both edges of the window covering area 110 are mounted for bidirectional traverse. It should be apparent that, as an alternative, one of the edge carriers could be fixed in position on the traverse track so that only the other edge of the drape is mounted for bidirectional traverse.

Each of the edge stabilizer arrangements is constructed to hold the edge pleats of the fabric section 110 in a substantially true vertical orientation when the fabric is traversed to the open condition shown. For purposes of this description, the open condition of the prepleated fabric (i.e., pleats open corresponds to what is normally considered the closed position of the overall drape assembly and the closed condition of fabric (i.e., pleats folded together) is the drape open position.

As will be seen more particularly in the description of the following drawing figures, the window covering system 105 also includes a traverse alignment arrangement, generally referred to in FIG. 18 by the reference numeral 116 specifically pointing at guide cord arrangements which extend through guide apertures in the prepleated fabric, but also including a tensioning means mounted on the stabilizer arrangement 115 which maintains the guide cords 117A and 117B in tension throughout the traverse of the fabric section 110 between open and closed positions. The tensioned guide cords 117A and 117B keep the sections of prepleated fabric in alignment so that they neatly fold as the drape is opened and the individual pleat sections are moved to their closed or folded condition.

Figure 19:
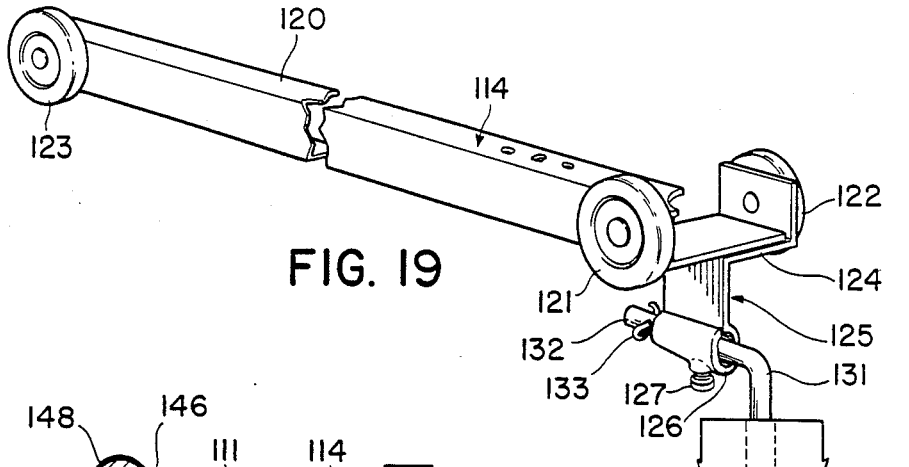
FIG. 19 is a perspective view illustrating a carriage and a mounting arrangement for a stabilizer rod assembly.
Figure 20:
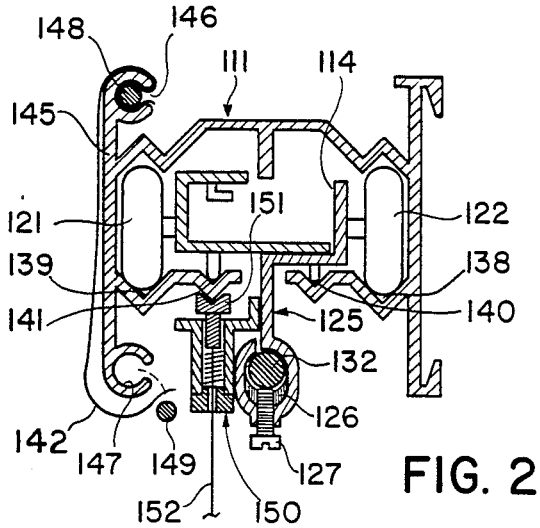
FIG. 20 is a sectioned side view illustrating a traverse track with carriage assembly and mounting arrangement for the stabilizer rod arrangement.
Figure 21:
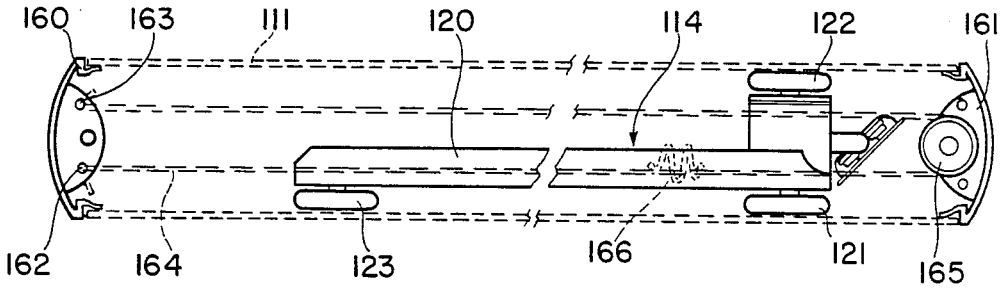
FIG. 21 is a top view of a carriage assembly and also showing a traverse cord and pulley arrangement.

The details of carrier arrangement 114 and traverse track 111 in the form of a currently preferred embodiment are shown in FIGS. 19–21. Edge carrier 114 is in this case a carriage arrangement having a main body section 120, a pair of opposed wheels 121 and 122 on one end thereof and a single wheel 123 on the opposite end thereof. The L-shape of carriage body 120 permits left and right units to mate closely for tight pack of the pleats in a drape open condition. A bottom wall section 124 of the carriage 120 has a mounting bracket 125 carried thereon, and the mounting bracket 125 includes a horizontal mounting channel 126 which extends parallel to the plane of traverse of the carriage 120 in the traverse track.

The edge stabilizer arrangement 115 includes a mounting bracket 130 with a generally L-shaped mounting rod 131 extending from a top portion thereof. An upper section 132 of the mounting rod 131 is received within the mounting channel 126. Preferably, the mounting channel 126 is formed with an outward taper from left to right as shown and the diameter of the channel at the left-most point is arranged to match substantially the diameter of the rod section 132. A cotter key 133 extending through an aperture in the rod section 132 captures it in the channel, but the rod section 132 is free to tilt upward or downward within the channel for angular adjustment of the stabilizer rod arrangement 115 to a obtain a truly squared drape edge. The adjustment screw 127 controls the tilt of the rod section 132. The tip of the screw and the left edge of the channel are pivot points which permit the rod section 132 to rotate in the channel about its center axis. This provides a pendulum mounting relation between the edge stabilizer rod 115 and the bracket 125. This permits the stabilizer rod to be rotated away from the wall (for example by a child wanting to see out of the window when the drape is closed) and automatically return to the true vertical position. Of course, it is important that adjustment screw 127 not be tightened to the point that the rod section 132 is clamped against the top wall of the mounting channel 126 and will not swing freely.

An alternative arrangement would involve tapering the rod section 132 and using a straight wall channel with the position of the adjustment screw controlling the tilt of the axis of the rod section 132.

As shown in FIG. 20, the wheels 121 and 122 of the carriage assembly 120 ride in carriage tracks 138 and 139 defined in the traverse track 111. Adjacent to the carriage tracks 138 and 139 are a pair of additional tracks 140 and 141 which carry the pleat hanger wheels.

The traverse track arrangement 111 is preferably formed from a one-piece aluminum extrusion with a front wall section 145 having integral top and bottom C-shaped grooves 146 and 147 formed therein. With this arrangement a section 142 of fabric can be stretched over the front wall 145 and edge sections of the fabric can be held within the C-shaped grooves 146 and 147 utilizing elongated mounting beads 148 and 149 which push into the C-shaped grooves 146 and 147.

FIG. 20 also shows a brake arrangement 150 carried on the bracket 126 of the carriage 120. Brake arrangement 150 includes a spring loaded brake shoe 151 which may interface with a bottom braking surface of the groove 141 to hold the carriage 120 in a fixed position against the spring tension forces that are applied to it by the traverse alignment arrangement which will be described below. In the arrangement shown the brake pad 151 can be pulled away from the traverse track using a cord 152 which is attached at the other end to a handle 155 shown in FIG. 17. To traverse the vertical drape, the brake arrangement 150 can be released by pulling down slightly on the handle 155 which allows the carriage 114 to freely traverse back and forth on the traverse track until the edge of the drape is in the desired position. Release of the handle 155 then causes the brake shoe to stop the carriage movement at the desired position.

In the alternative, a brake arrangement can be structured to function as an automatic brake such as shown in FIG. 31 and described below. This is accomplished by providing for adjustment of the brake force applied by the spring such that the braking force is sufficient to overcome the intrinsic forces tending to move the carrier and drape toward the open condition in the absence of externally applied force. With externally applied force the edge carrier and the stabilizing rod will move in the direction of the force until it is removed and then automatically be stopped at that position by the brake. As will be discussed below, the intrinsic forces include the spring tension of the prepleated fabric itself and the tension on the guide cords as described below.

FIG. 21 shows an alternative system in which the movement of the carriage 120 is controlled by a traverse cord arrangement. In the arrangement shown in FIG. 21, a single direction traverse of carriage 120 is provided. A pair of end caps 160 and 161 are mounted on the end of the traverse track 111. End cap 160 has a pair of apertures 162 and 163 in the form of eyelets through which the traverse pull cord 164 may be extended. A pulley 165 is provided on the end cap 161 for reversing the direction of the traverse cord 164. The cord holding arrangement 166 is provided on the carriage 114 and may comprise any type of cord clamping arrangement which holds the carriage 114 onto the traverse cord at a fixed position.

Using this traverse cord positioning arrangement, a means must be provided for holding the carriage 114 in a selected position. The automatic braking system would preferably be used for this version. Position holding can also be achieved using a cord fastening bracket mounted to the wall underneath the traverse track utilizing any one of the cord rapping bracket approaches which are standard in the art. Cord grabbing brake arrangements could also be employed.

Referring now to FIG. 19 in conjunction with FIGS. 22–25, one version of an edge stabilizer arrangement 115 and traverse alignment arrangement 116 will be described. Stabilizer rod arrangement 115 incorporates housing 170 which is preferably in the form of an elongated section of aluminum extrusion having a first main wall portion 171 and a second main wall portion 172. Wall portions 171 and 172 form a generally triangularly shaped housing. A pair of C-shaped grooves 173 and 174 are formed on the opposite ends of wall section 171 to provide an arrangement for mounting an elongated strip of fabric 175 over the wall section 171 in the manner shown best in FIG. 24. Long, flexible, cylindrical beads 176 and 177 are used to push the edge sections of the fabric 175 into the C-shaped grooves to hold the fabric section tightly in place on the wall section 171.

Figure 22:
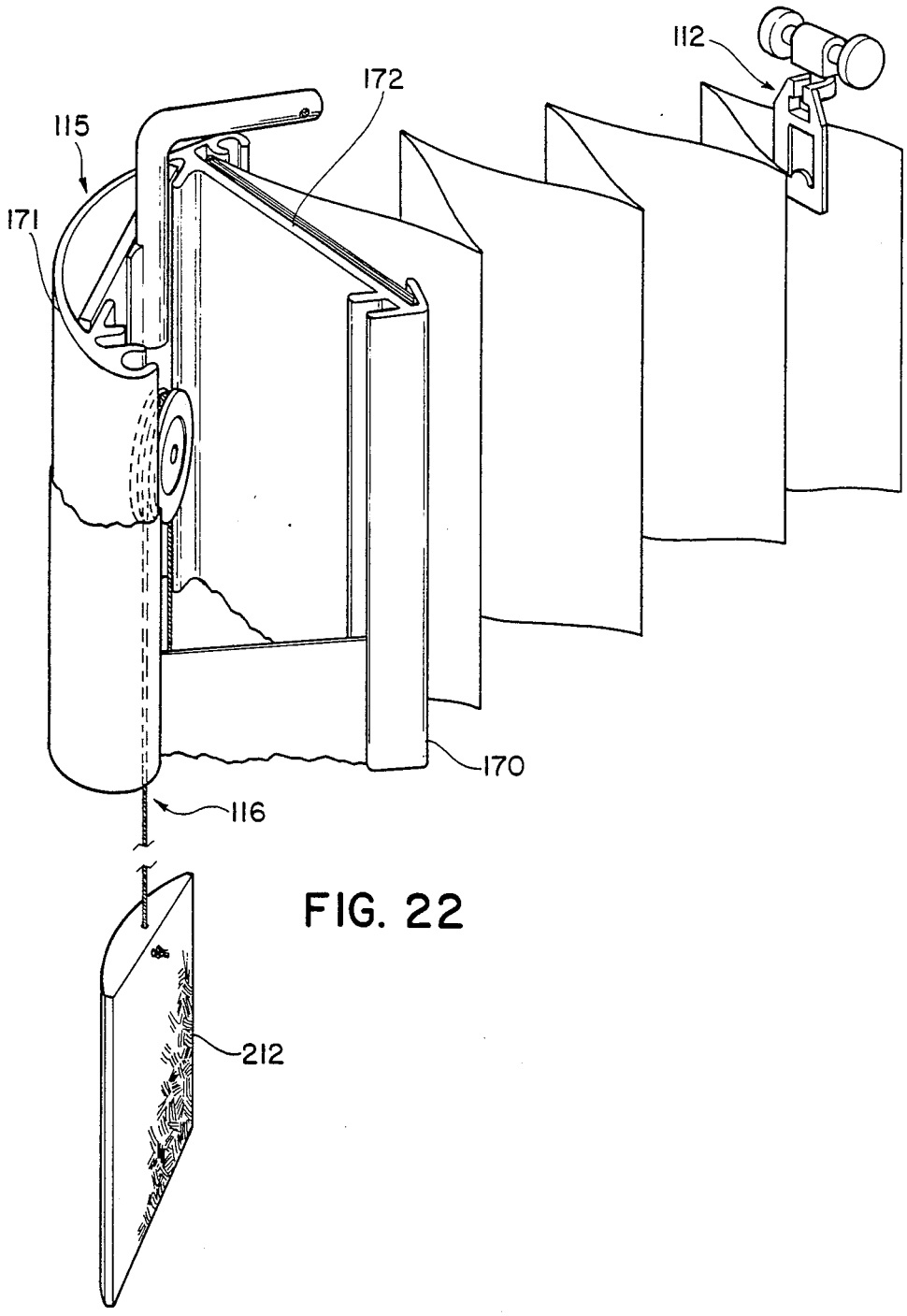
FIGS. 22–25 illustrate features of a preferred stabilizer rod assembly and traverse alignment arrangement in accordance with this invention.
Figure 23:
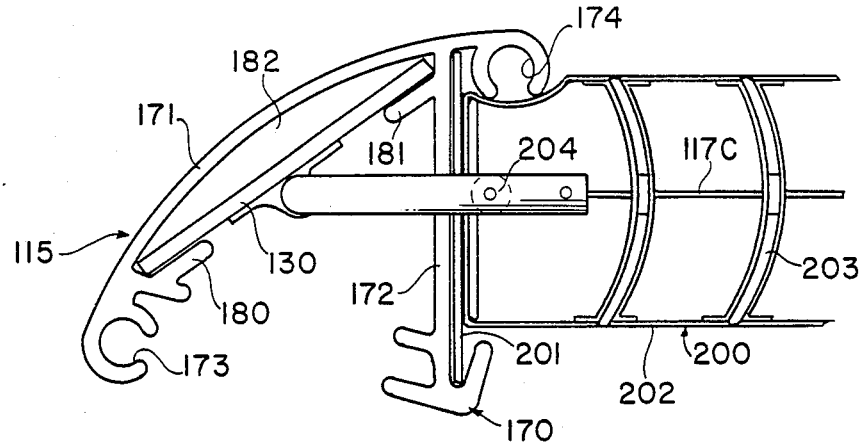

Interior to wall section 171 are a pair of oppositely facing ear portions 180 and 181 which define an internal vertical channel 182 which extends the entire length of the housing 170. As shown in FIGS. 22 and 23, mounting bracket 130 is positioned within the channel 182 and then fixed in a position within the channel using any convenient means. For example, the width of the bracket 130 can be such as to provide a tight interference fit between the vertical edges of the bracket 130 and the edges of the channel 182.

Figure 24:
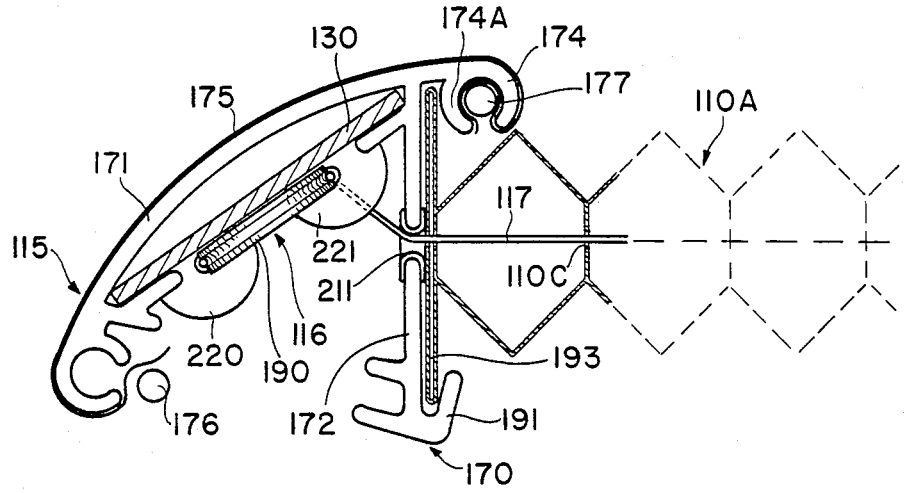
Figure 25:
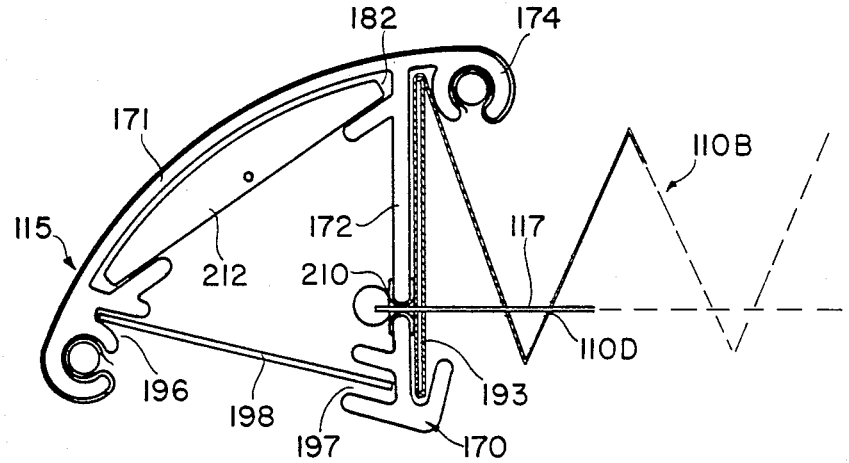

The bracket 130 preferably carries thereon a rotating pulley 190 which is a part of the traverse alignment arrangement 116. This will be described in more detail later. An interior wall portion 174A of the C-shaped bracket 174 cooperates with an ear 191 extending from the opposite end of wall section 172 to define a set of opposed grooves that are adapted to receive a slat 193 to which is fastened a section of the prepleated drapery fabric as shown in FIGS. 24 and 25. In FIG. 24, a section of the hexagonal pleat of the DUETTE double pleat type of prepleated drapery fabric extends around the slat 193. Preferably the slat 193 extends the full length of the stabilizer rod housing 170 so that the entire edge pleat is captured in position adjacent the housing wall section 172. As shown in FIG. 25, one or more entire edge pleats of a single pleat drapery fabric 110B may be wrapped around the slat 193 to capture the edge pleat against the wall section 172.

As shown in FIG. 25 a pair of opposing grooves 196 and 197 may be defined on the free ends of wall sections 171 and 172 to permit an elongated metal slat 198 to be inserted therein to completely enclose the interior of the housing 170. This keeps all of the moving parts within the housing 170 completely enclosed for safety purposes but with the back wall removable for repair or replacement of parts. The groove 197 is shown oversize in the drawing figures and may in fact be formed only slightly wider than the thickness of the slat 198 itself.

Referring back to FIG. 23, a mounting arrangement for a vertical blind system 200 is illustrated. In this case a special slat arrangement 201 is provided to mount one end of a string or tape ladder arrangement 202 to the housing 170. In this arrangement each of the blind slats 203 would be mounted for traverse in the traverse track arrangement 111 utilizing any of the conventional slat to track mounting arrangements. Depending on the height of the vertical blind, two or three ladder arrangements 202 may be provided at spaced vertical positions thereon.

In the case of a vertical blind arrangement, the edge stabilizer rod arrangement 115 is mounted in a vertically swivelling manner around an axis such as the axis 204 so that the individual blind slats 203 can be rotated between open and closed individual slat positions in addition to the entire blind being traversed between open and closed positions. Any suitable arrangement for pivotal mounting of the stabilizer rod arrangement 115 can be employed. For example, referring back to FIG. 19, the bracket arrangement 125 may include a pivoting ball and socket arrangement similar to the pivoting ball and socket arrangement shown in FIG. 22 for mounting the individual sections of the drapery fabric for traverse on the traverse track. It is important, however, that the stabilizer rod have freedom to rotate and swing out from the wall, but not be free to pivot in the plane of traverse of the blind.

It should be apparent, from the above description of the stabilizer rod arrangement 115 of this embodiment of the invention, that the housing 170 is held in a fixed vertical position by the mounting arrangement shown in FIG. 19 and is thus able to hold the edge portion of a prepleated fabric drapery section or the edge portion of a vertical drape arrangement in a substantially precise vertical alignment by opposing the inherent distortion forces which tend to otherwise cause the edge sections not to be disposed in a precise vertical alignment. This solves one of the major problems involved in utilizing prepleated drapery fabric as described above. It also solves one of the problems involved in utilizing tape or string ladders on vertical blind systems as previously described.

The traverse alignment arrangement 116 will now be described in conjunction with drawing FIGS. 18 and 22–27. The principles of the preferred traverse alignment arrangement 116 of this invention are depicted schematically in FIGS. 26 and 27. In each of the arrangements shown in FIGS. 26 and 27, two separate traverse alignment arrangements 116 are depicted to provide two regions of traverse alignment across the height of the vertical drape material section 110. It should be understood that if the drapery section 110 is short enough, it may be sufficient to use only a single one of the traverse alignment arrangements 116.

Figure 26:
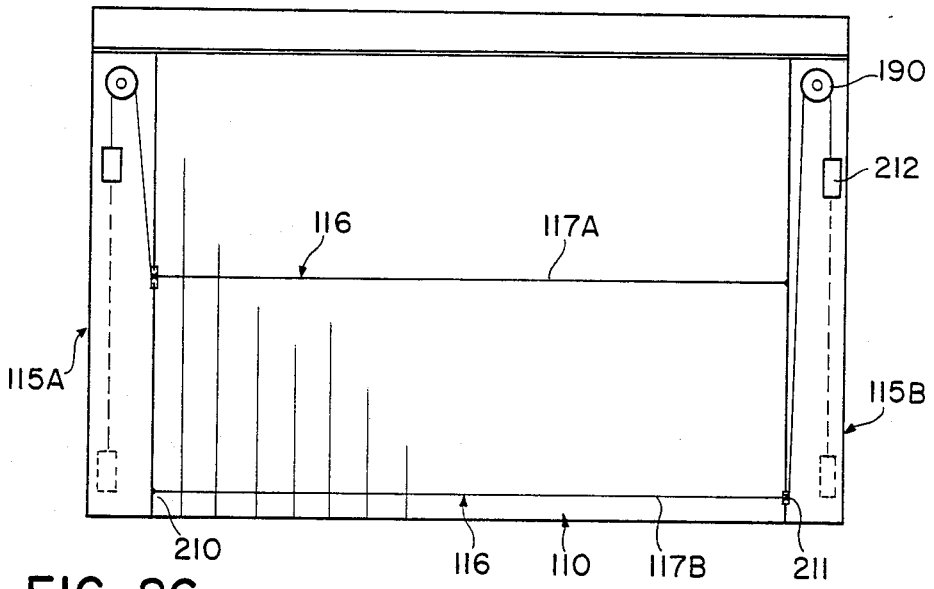
FIGS. 26 and 27 illustrate alternative pulley and weight arrangements for a traverse alignment system in accordance with this invention.
Figure 27:
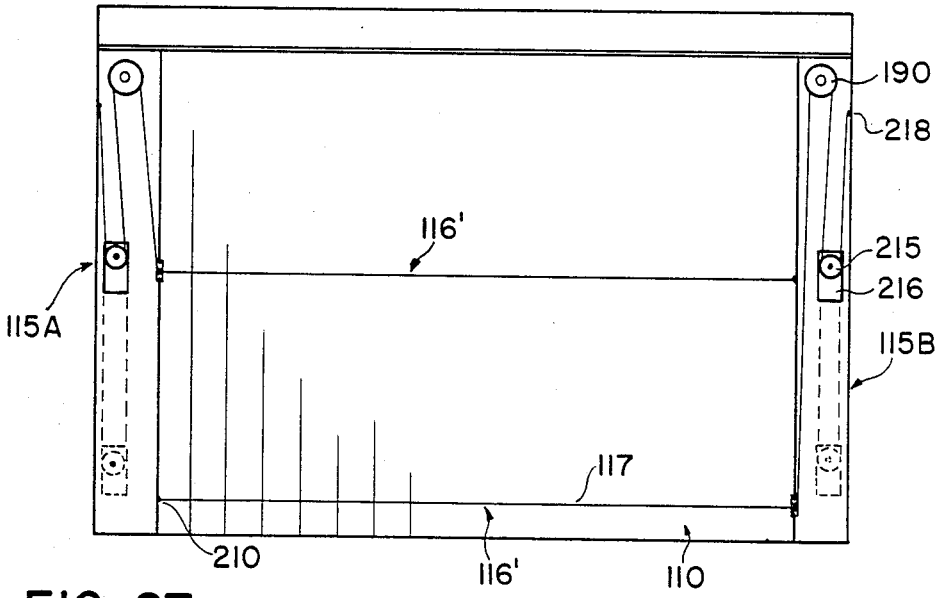

FIG. 26 illustrates a single pulley traverse alignment arrangement 116. FIG. 27 illustrates a double pulley traverse alignment arrangement 116'.

In the single pulley arrangement 116 shown in FIG. 26, one end of the guide cord 117B is fixed at one end 210 to one of the stabilizer rod arrangements 115A. The guide cord 117B extends through a grommetted aperture 211 in the stabilizer rod assembly 115B and wraps around a pulley 190 with a weight 212 attached to the free end of the guide cord 117B. A similar arrangement is provided for the guide cord 117A. The arrangement of weight 212 and pulley 190 maintains tension on the guide cord 117B during traverse of one or the other or both of the stabilizer rod arrangements 115A and 115B. In other words, as the relative position of the stabilizer rod arrangements changes the position of the weight 212 changes but the tension in the guide cord 117B remains the same. This tension guide cord cooperates with the apertures in each of the fabric sections of the prepleated drapery fabric 110 to maintain these fabric sections in proper alignment during the traverse of the drape.

The single pulley arrangement of FIG. 26 adequately covers the situation where the total horizontal traverse of the drape is less than or equal to the vertical height of the drape. The double pulley arrangement shown in FIG. 27 adapts the traverse alignment arrangement for situations in which the overall width of the drape is substantially greater than the length. In other words the double pulley arrangement provides for a greater effective change in the working length of the guide cord 117 during the traverse of the vertical drape system.

In the double pulley system shown in FIG. 27 a fixed pulley 190 combines with a traveling pulley 215 which is mounted on the weight 216 to travel therewith. In this case, one end of the guide cord 117 is fixed at a point 210 to the stabilizer rod arrangement 115A and is fixed at the other end to a point 218 on the stabilizer rod arrangement 115B.

Referring back to FIG. 25, the weight 212 is preferably mounted for up and down traverse in the channel 182 formed on the interior of the housing 170 which comprises the main body of the stabilizer rod arrangement 115. This approach can be used for both the case in which the weight 212 has the end of the guide cord 117 attached thereto and the case in which the weight has a pulley mounted thereon as shown in FIG. 27.

FIG. 25 illustrates that one end of the guide cord 117 preferably extends through a grommetted aperture at the point of attachment 210. At this point a large knot in the guide cord can be formed or a restraining button or tab can be crimped onto the guide cord to fix its position at that point. FIG. 24 illustrates the grommetted aperture 211 in the wall 172 of housing 170 through which guide cord 117 may be fed. A pair of cord guide tabs 220 and 221 are preferably formed on the mounting bracket 130 underneath the pulley 190 to guide the cord on and off the pulley 190. This is preferable since the direction of the cord changes between the grommetted aperture 211 and the pulley and between the other side of the pulley and the point of attachment to the weight 212. Thus these guide tabs help to maintain the cord in proper alignment on the pulley 190.

As shown in FIGS. 23 and 24, the guide cord 117C for the vertical blind arrangement depicted in FIG. 23 is preferably placed in a symmetrical center position relative to each of the blind slats 203. In that embodiment a cord slot would be provided in each of the blind slats to receive the guide cord 117C. In the case of the double pleated fabric 110A shown in FIG. 24, the guide cord 117 preferably extends symmetrically through the center of the double pleated fabric with an aperture 110C being formed in each of the center wall sections as shown. In the single pleated fabric embodiment shown in FIG. 25 the guide cord 117 is preferably extended through apertures 110D which are formed towards the rear portion of each of the sections of pleats. This tends to reduce the length of the segments of cords that are visible from the front of the drape, giving it a more pleasant overall aesthetic appearance.

FIGS. 28–30 illustrate a bracket arrangement 230 for mounting the traverse track 111 to the wall above a window or door. A first bracket member 231 is provided for mounting to the wall in an adjustable position by utilizing a screw extending through the slot 232. If desired, a pair of elongated mounting slots could be provided in the bracket element 231. A second bracket member 233 is fastened to the first bracket member 231 utilizing a rotating detent arrangement 234. Bracket member 233 carries a male tab 235 on the underside thereof. Male tab 235 is adapted to be received in a female slot 236 in a third bracket member 237. The third bracket member 237 defines a pair of shoulder portions 238 and 239 which cooperate with lips or other structures on the traverse arrangement 111 so that traverse arrangement 111 hangs on the bracket member 237.

To assemble the hanging bracket arrangement 230, bracket members 231 and 233 are first placed in an aligned position and the male tab 235 inserted into the female slot 236. Bracket member 233 is then twisted relative to bracket member 231 so that the male tab 235 rotates relative to the female slot 236 to capture the bracket members 233 and 237 together.

It should be apparent that a variety of other mounting bracket arrangements could be used for hanging the traverse track section 111 employed in connection with this embodiment of the invention.

Referring back to FIGS. 23–25 together with FIGS. 17 and 18, it should be apparent that the housing 170 which defines the main structural element of the edge stabilizer rod arrangement 115 can be used at both edges of the vertical drape arrangement 105. The two extrusion sections are simply vertically reversed for the left and right sides of the vertical drape assembly. Each of the other elements of the edge stabilizing rod arrangements and for the traverse alignment arrangements which are mounted internally to the extruded housing 170 can be fit in their appropriate position within the housing depending on whether the assembly is for the right or left side of the vertical drape or blind system.

Referring to the traverse alignment arrangement, it should be apparent that other tensioning means than the pulley and weight arrangement could be used, but probably not to the same advantage of maintaining constant tension in the guide cord 117. For example it would be possible to fasten one end of the guide cord to a tension spring positioned within the housing 170 of the edge stabilizer rod arrangement 115. It might also be possible in some circumstances to utilize an elastic guide cord 117. However in each case, the differential length where an elastic member is used also results in a differential tension. This makes the force required for traversing the drape to a full open condition vary with the position of the edge of the drape. This would likely preclude use of an automatic brake. In the preferred embodiment the amount of forced required to overcome the friction of the various wheels and hanging weight in the traverse alignment means is constant.

FIG. 31 illustrates an arrangement of a traverse track 111 and carriage 114 of the type illustrated in FIGS. 19 and 20, but with a pair of automatic braking arrangements 251 and 252. Each of these braking arrangements may comprise an L-shaped body of spring steel material fastened to the lower bracket 125 of the carriage assembly. A plastic brake element 254 carried on the spring steel body is urged into braking contact with a bottom surface of the track 111. A threaded portion on the brake element permits adjustment of the amount of braking force. In general the braking force is set such to a value such that the carriage 114 will remain in position when the inherent pulling forces of the prepleated fabric and the traverse alignment arrangement are at their maximum total value. The automatic brakes will then hold the carriage at rest at any position with a braking force that is easily overcome by additional manual force pushing on the stabilizing edge rod assembly mounted to the carriage.

The arrangement shown in FIGS. 19 and 20 for mounting the edge stabilizer assembly to the carriage assembly is quite satisfactory for vertical drapes that are relatively short (e.g. in the range of thirty or forty inches long), but may encounter problems in longer drape units that may be as much as eighty or ninety inches long. In the longer drape units, there is a possibility for a child, for example, to apply a force to the lower portion of the edge stabilizer rod assembly. Because of the design of the mounting arrangement, a force applied at this position tends to build up a torque in the carriage assembly and mounting bracket rather than to cause the carriage assembly to move in the direction of the applied force. This torque may, in some cases, build up to a quite high level before the carriage assembly begins to move in response to the force. In the process, this high torque value could cause a bending of the mounting rod or the mounting bracket or the carriage assembly.

FIGS. 32–35 illustrate a mounting arrangement with a rotational detented safety release action in the plane of the window covering material to prevent damage to the system under the conditions described above. A U-shaped vertical bracket 260 formed by front and back vertical walls 264 and 265 and side wall 266 is at the top of the stabilizer rod assembly. As shown in FIG. 32, bracket 260 is mounted in the interior of the extrusion housing 261 with ears 267 and 268 received in a groove defined by projections 262 and 263. Any convenient securing arrangement may be employed to hold the bracket 260 in position at the top region of the stabilizer rod housing 261.

Front and back vertical walls 264 and 265 have a pairs of upper and lower safety detent aperture patterns 271,272 and 273,274 formed therein. Vertical mounting rod portion 132 extends between the front and back walls and carries thereon upper and lower pairs of rollers 275 and 276. Each of the rollers is received in an associated one of the detent aperture patterns. A compression spring 278 extends between a horizontal platform 277 on the bracket 260 and the bottom end of the vertical rod portion 132 to bias the mounting rod toward the rest position shown in solid lines in FIG. 33. Horizontal platform 277 may be formed from a cut out and bent section of side wall 266 as shown in FIG. 34. A pulley 279 is mounted in the bottom of bracket 260 to carry tensioning cord 117.

Figure 33:
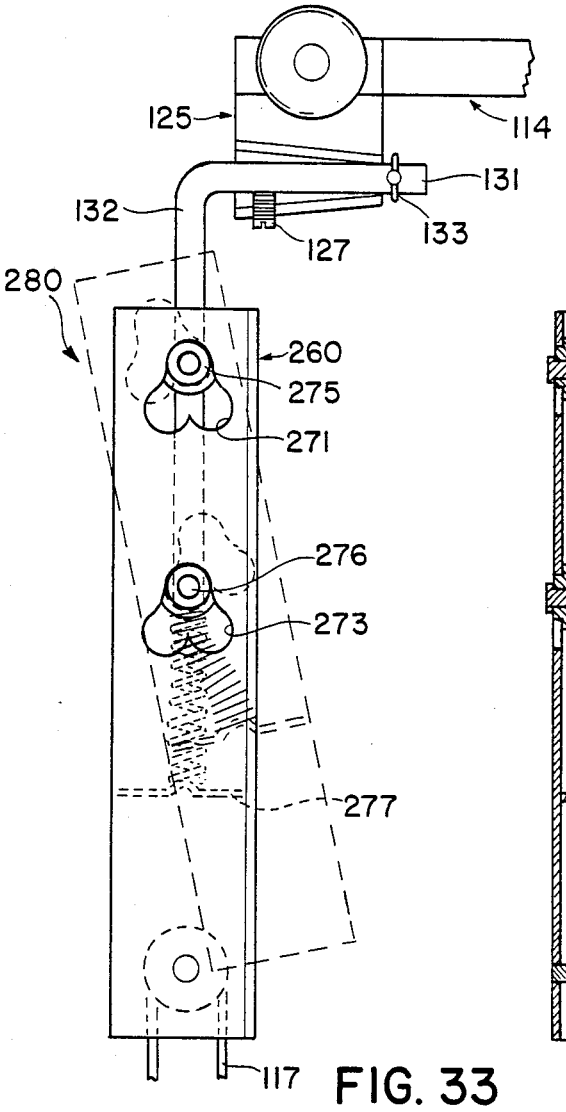
Figure 34:
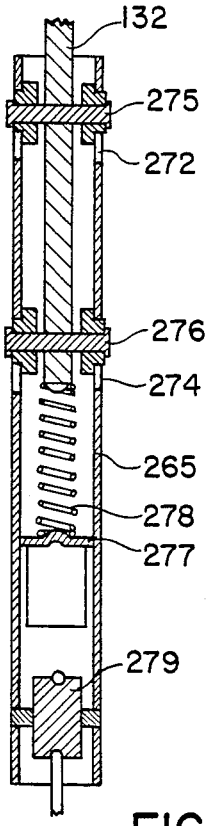
Figure 35:
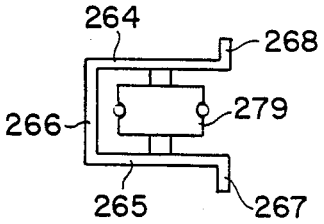

FIG. 33 illustrates in dashed lines the position assumed by the vertical bracket 260 relative to the vertical rod portion 132 when the rotational detented safety release action has been acutated. The vertical bracket 260 rotates and moves upward as the rollers 275 move into the lower right release locations of the detent aperture patterns 271 and 272 and the rollers 276 move into the lower left release locations of the detent aperture patterns 273 and 274. The compression spring 278 is compressed further and distorts When the torque is released, the compression spring urges the bracket back toward the rest position.

This safety torque release feature reduces substantially the risk of damage to the components of the system if a horizontal force is exerted near the bottom of the vertical stabilizing bar arrangement on a long vertical drape assembly. The rotation of the vertical stabilizing bar assembly to the release locations places the bar at an angle to the vertical at which the applied horizontal force is likely to begin to move the carriage assembly in the direction of the applied force.

This safety torque release feature is preferably designed such that it does not come into operation when a force is exerted on the upper half of the vertical edge stabilizing bar arrangement where the torque value is lesser and the force will tend to move the carriage assembly quite readily in the direction of the applied force.

Figure 36:
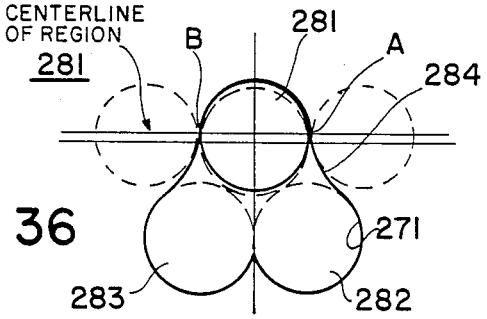
FIG. 36 is an enlarged view of a safety detent aperture pattern used in the mounting arrangement of FIGS. 32–35.

FIG. 36 illustrates the details of one version of a detent aperture pattern that gives satisfactory operation of the safety release mechanism. Three circular regions 281, 282, and 283 make up the pattern. Circular region 281 defines the rest location of the associated roller and circular regions 282 and 283 define adjacent torque relief regions into which the associated roller may move depending on the direction of the applied torque. To set a threshold of torque required to move the roller out of the rest position, the associated circular region 281 is formed with its centerline slightly above the position of a circle touching the two adjacent regions 282 and 283. The shape of the aperture wall portions 284 and 285 also appears to affect the breakout torque threshold required to move the roller from the rest position to one of the relief positions. It appears to be preferable to start the tapering of the wall portions 284 and 285 from points A and B located slightly above the horizontal centerline of the rest circular region 281 to obtain a satisfactory breakaway action.

In addition to the shape considerations of the detent aperture pattern, the spring force applied by the compression spring 278 also figures importantly into the breakout torque threshold value. If desired, an adjustment screw could be provided between the platform 277 and the associated lower end of compression spring 278 to adjust the amount of spring pressure applied between the mounting platform and the vertical rod portion 132.

FIGS. 37 and 38 depict an alternative mounting arrangement for the edge stabilizing rod arrangement to accomplish a rotational detented safety release action. In this embodiment a U-shaped vertical bracket 290 has a single pair of safety detent aperture patterns 291 in the front and back walls cooperating with a roller pair 293 mounted on the vertical mounting bar portion 132. A pair of central guide apertures 292 cooperate with a roller pair 294 to maintain a guided vertical alignment of the bar portion 132 during the safety release detent action as shown. Compression spring 296 and horizontal platform 295 perform the same functions is this embodiment as they do in the above described embodiment.

It should be apparent that other embodiments of mounting arrangements with rotational detented safety release action could be provided. For example, a compound mounting bracket (not shown) having a lower bracket member fastened to the stabilizer rod housing and an upper bracket member free to move back and forth within the housing could be used. The upper bracket member would be spring loaded with respect to the lower bracket member and would have at least one detent aperture pattern therein together with a vertical guide aperture.

The above-described embodiments of this invention are given by way of example only. It will be apparent to the person of skill in this art that numerous modifications could be made to the details of the specific embodiments disclosed without departing from the overall concepts of the invention which produce the advantageous operating features set forth herein. The invention could be adapted to a variety of traverse track arrangements in general and specifically could be adapted to various types of carriers for the edge pleat stabilization arrangements. Thus modifications could be made without departing from the scope of the invention as claimed in the following claims.

What is claimed is:

1. In a covering system for openings such as windows, a covering material portion having a plurality of sections disposed in a generally vertical orientation, said portion being adaptable to being traversed between open and closed conditions and having inherent distortion characteristics causing non-vertical hanging of left and right edge portions thereof in an open or partially open condition and misalignment out of the plane of traverse when traversing from an open to a closed condition; a traverse track adapted to be mounted typically in a horizontal orientation; a plurality of track mounting means for mounting a plurality of sections of said window covering material intermediate said left and right edge portions thereof for bidirectional traverse relative to said traverse track; first and second edge carrier means mounted to said traverse track with at least one of the first and second carrier means adapted for bidirectional traverse on said track; first and second edge stabilizer means each including a bracket mounted to said respective first or second edge carrier means, and an elongated edge stabilizer member mounted to said bracket and holding a respective one of said left and right edge portions of said window covering material in a substantially straight, substantially rigid vertical orientation, including when said material is traversed toward an open condition, with a degree of rigidity sufficient to overcome said inherent distortion characteristic; and traverse alignment means for maintaining the alignment of said vertical material sections during traverse toward said open and closed conditions, said traverse alignment means including guide apertures formed in said vertical material sections, an extendible guide cord routed through said guide apertures and tensioning means operatively connected to said guide cord for maintaining said guide cord in substantial tension throughout the traverse of said material portion between said open and closed conditions.

2. In a vertical window covering system, a window covering material portion having a plurality of sections disposed in a generally vertical orientation, said portion being adaptable to being traversed between open and closed conditions and having an inherent distortion characteristic causing non-vertical hanging of left and right edge portions thereof in an open or partially open condition, a traverse track adapted to be mounted in a horizontal orientation; a plurality of track mounting means for mounting a plurality of sections of said window covering material intermediate said left and right edge portions thereof for bidirectional traverse relative to said traverse track; first and second edge carrier means mounted to said traverse track with at least one of said carrier means adapted for bidirectional traverse on said track; and edge stabilizer means mounted on each of said carrier means for holding said edge portions of said window covering material in a substantially straight vertical orientation when said material is traversed toward an open condition, including a stabilizer rod means mounted to said carrier means in an accurate vertical orientation and with a degree of rigidity sufficient to overcome said inherent distortion characteristic, said stabilizer rod means extending at least substantially the entire length of an associated one of said edge portions of said window covering material and being secured thereto at least at a plurality of locations throughout said length; wherein said window covering material portion includes a plurality of vertical material portions which move together as said material is traversed toward a closed condition and has the further inherent distortion characteristic operating during traversing toward said closed condition tending to cause said vertical material portions to become misaligned in a direction perpendicular to the general plane of traverse, and further comprising traverse alignment means for maintaining the alignment of said vertical material portions during said traverse toward said closed condition, said traverse alignment means including guide apertures formed in said vertical material portions at a prearranged position near a bottom edge thereof, guide cord means extending through said guide apertures and being fastened to one of said stabilizer rod means, and tensioning means operatively mounted to the other of said stabilizer rod means for maintaining said guide cord in substantial tension throughout the traverse of said material portion between said open and closed conditions.

3. The system of claim 2, wherein said window covering material portion comprises an area of prepleated drapery fabric having permanently set pleats of a nature such that the fabric behaves like a tension spring tending to bias pleats toward the folded state and thus causing a distortion characteristic of said right and left edge portions tending to bow inwardly from top to bottom in an open condition of said drape.

4. The system of claim 2, wherein said window covering material portion comprises an area of vertically disposed blind slats each mounted by one of said track mounting means to said traverse track and a plurality of string ladders carried thereon at spaced vertical locations and fastened at respective right and left ends to said stabilizer rods, the weight of said string ladders tending to cause said distortion characteristic with ones of said blind slat at right and left edges bowing inwardly from top to bottom.

5. The system of claim 2, wherein said window covering material portion comprises an area of prepleated drapery fabric having permanently set pleats of a nature such that the fabric behaves like a tension spring tending to bias pleats toward the folded state and thus causing a distortion characteristic of said right and left edge portions tending to bow inwardly from top to bottom in an open condition of said drape and wherein said window covering material portion has an overall width such that, when said drape has been held in an open condition for a substantial time, said prepleated folds tend to misalign rather than pleating neatly together as said drape is traversed toward a closed condition, each section of each of said pleats having said guide apertures formed therein and having said guide cord extending therethrough.

6. The system of claim 2, wherein said window covering material portion comprises an area of vertically disposed blind slats each mounted by one of said track mounting means to said traverse track and a plurality of string ladders carried thereon at spaced vertical locations and fastened at respective right and left ends to said stabilizer rods, the weight of said string ladders tending to cause said distortion characteristic with ones of said blind slat at right and left edges bowing inwardly from top to bottom; said string ladders having side wall portions adapted to fold as said vertical blind is traversed toward a closed condition but being stiff enough to tend to produce uneven folding and distortion of slat position, each of said blind slats having one of said guide apertures therein with said guide cord extending therethrough.

7. The system of claim 6, wherein said stabilizer rod means has a transverse dimension at least about equal to the width of each of said blind slats, said guide apertures in said blind slats comprise elongated guide cord receiving slots; and further comprising mounting means for mounting each of said stabilizer rods to said carrier means in a rotational mounting relationship relative to the plane of traverse of said blind so that said stabilizer rod means can be set to various angles to correspondingly set the angle of each of said blind slats relative to said plane of traverse.

8. The system of claim 2, further comprising a pleat position stabilizing means mounted to each of said plurality of spaced intermediate pleats for stabilizing said pleats in a vertical orientation.

9. The system of claim 8, wherein said pleat position stabilizing means comprises a weight fastened to a bottom portion of an associated pleat to bias said pleat to hang vertically.

10. The system of claim 8, wherein said pleat position stabilizing means comprises an elongated thin slat fastened to said pleat and extending at least substantially the entire length thereof, said slat being carried on said track mounting means associated with each said intermediate pleat.

11. The system of claim 8, wherein said pleat position stabilizing means comprises an elongated thin slat fastened to said pleat and extending at least substantially the entire length thereof and a weight mounted to said slat at a bottom portion thereof, said slat being carried on said track mounting means associated with said pleat.

12. The system of claim 3, wherein said stabilizer rod means includes an integral spring flexure portion near a top end thereof adapted to respond to a sidewise force applied toward the bottom portion thereof of a magnitude substantially greater than the spring force of said drapery fabric by flexing and then restoring said stabilizer rod means to a true vertical orientation.

13. The system of claim 3, wherein each of said drape edge carrier means and said drape edge stabilizer means together comprise a modular unit; each of said drape edge carrier means defines a horizontal mounting platform for said drape edge stabilizer means; said modular unit including stabilizer rod mounting means for mounting said stabilizer rod means to said mounting platform in an adjustable vertical position and an adjustable angular orientation relative to said mounting platform to enable precise adjustment of said stabilizer rod to extend perpendicular to said mounting platform.

14. The system of claim 13, wherein said stabilizer rod means includes an upper rod end having a regular cylindrical shape; and said stabilizer rod mounting means comprises a cylindrical mounting bracket rigidly mounted to a bottom surface of said mounting platform and having a tapered central aperture therein receiving said upper rod end of said stabilizer rod means and a triangular arrangement of set screws extending between an outer cylindrical wall of said bracket and said central aperture adapted for adjustable contact with said upper rod end for providing both a vertical adjustment of the position of said upper rod end in said tapered aperture and an angular adjustment of the orientation of said upper rod end relative to said mounting platform.

15. The system of claim 13, wherein said stabilizer rod means includes an upper rod end having a regular cylindrical shape; and said stabilizer rod mounting means comprises an aperture defined in said mounting platform and having a tapered wall portion adapted to receive said upper rod end in a variable angular orientation, a mounting collar fastened over said upper rod end on one side of said mounting platform, a compression spring carried over said upper rod end on the other side of said mounting platform, and a spring retaining bracket mounted to said upper rod end to compress said spring between a wall surface of said mounting platform and said retaining bracket, said mounting collar including first adjustment means for adjustably positioning said mounting collar on said upper rod end and second adjustment means for defining an adjustable angular contact relationship between said mounting collar and said mounting platform to establish an initial angular orientation for said mounting collar and said upper rod end, said upper rod end and said collar being deflectable away from said initial orientation and being biased by said compression spring to return to said initial orientation.

16. The system of claim 15, wherein said mounting collar has a central aperture receiving said upper rod end, said first adjustment means comprises a horizontally disposed set screw extending between an outer wall and said aperture for fastening said collar on said upper rod end in an adjustable position, and said second adjustment means comprises a triangular arrangement of set screws extending through said collar parallel to said aperture with screw tips contacting an adjacent surface of said mounting platform to jointly provide said adjustable angular contact relationship between said mounting collar and said mounting platform.

17. In a vertical drape system, a two dimensional area of a prepleated drapery fabric having permanently set pleats of a nature such that the fabric behaves like a tension spring tending to bias pleats toward the folded state; a traverse track adapted to be mounted in a horizontal orientation and comprising structural means defining an elongated, generally C-shaped track with an open bottom slot extending the length of said track, said track defining a pair of internal track locations for traverse rollers and a pair of external, horizontally projecting shoulders extending the length thereof to provide carrier guide tracks; a plurality of traverse rollers carried in said track and carrying thereon a plurality of elongated strips each fastened along its length to one of a plurality of spaced pleats of said fabric intermediate left and right edge pleats thereof to provide bidirectional traverse of said strips and said associated pleats in said track; a pair of carrier means carried on said traverse track with at least one of said carrier means mounted on said carrier guide tracks for bidirectional traverse thereon; each of said carrier means carrying thereon a drape edge stabilizer means for holding an associated one of said right and left edge pleats in a substantially true vertical orientation when said drapery fabric is traversed to an open state despite said spring bias forces in said fabric, said drape edge stabilizer means comprising an elongated stabilizer rod means extending at least substantially the entire length of an associated one of said edge pleats and being fastened thereto; means for mounting said stabilizer rod means to said carrier means in adjustable vertical and angular orientation to place the vertical and angular position of said associated edge pleat of said drape in said true vertical orientation; and flexure means associated with one or both of said stabilizer rod means and said mounting means for providing spring biased flexure of said stabilizer rod means relative to said carrier means at a top region of said stabilizer rod means so that said stabilizer rod means may be temporarily deflected away from said true vertical orientation by a force applied thereto greater than said spring bias force of said drapery material and then return to said true vertical orientation when said force is removed.

18. In a vertical drape system, a two dimensional area of a prepleated drapery fabric having permanently set pleats of a nature such that the fabric behaves like a tension spring tending to bias pleats toward the folded state; a traverse track adapted to be mounted in a horizontal orientation and comprising structural means defining an elongated, generally C-shaped track with an open bottom slot extending the length of said track, said track defining a pair of internal track locations for traverse rollers and a pair of external, horizontally projecting shoulders extending the length thereof to provide carrier guide tracks; a plurality of traverse rollers carried in said track and carrying thereon a plurality of elongated strips each fastened along its length to one of a plurality of spaced pleats of said fabric intermediate left and right edge pleats thereof to provide bidirectional traverse of said strips and said associated pleats in said track; a pair of carrier means carried on said traverse track with at least one of said carrier means mounted on said carrier guide tracks for bidirectional traverse thereon; each of said carrier means defining a horizontal mounting platform and carrying thereon a drape edge stabilizer means for holding an associated one of said right left edge pleats in a substantially true vertical orientation when said drapery fabric is traversed to an open state despite said spring bias forces in said fabric, said mounting platform having an aperture therethrough with a tapered wall portion, said drape edge stabilizing means comprising a stabilizer rod means and stabilizer rod mounting means for mounting said stabilizer rod means in said aperture in said mounting platform in an adjustable vertical position and an adjustable angular orientation relative to said mounting platform to enable precise adjustment of said stabilizer rod to extend perpendicular to said mounting platform; said stabilizer rod means includes an upper rod end having a regular cylindrical shape; and said stabilizer rod mounting means mounts said upper rod end in said aperture in said mounting platform in a variable angular orientation and comprises a mounting collar fastened over said upper rod end on one side of said mounting platform, a compression spring carried over said upper rod end on the other side of said mounting platform, and a spring retaining bracket mounted to said upper rod end to compress said spring between a wall surface of said mounting platform and said retaining bracket, said mounting collar including first adjustment means for adjustably positioning said mounting collar on said upper rod end and second adjustment means for defining an adjustable angular contact relationship between said mounting collar and said mounting platform to establish an initial angular orientation for said mounting collar and said upper rod end, said upper rod end and said collar being deflectable away from said initial orientation and being biased by said compression spring to return to said initial orientation.

19. A vertical drape system as claimed in claim 18, wherein said mounting collar has a central aperture receiving said upper rod end, said first adjustment means comprises a horizontally disposed set screw extending between an outer wall and said aperture for fastening said collar on said upper rod end in an adjustable position, and said second adjustment means comprises a triangular arrangement of set screws extending through said collar parallel to said aperture with screw tips contacting an adjacent surface of said mounting platform to jointly provide said adjustable angular contact relationship between said mounting collar and said mounting platform.

20. A vertical drape system as claimed in claim 19, wherein said adjacent surface of said mounting platform defines three indented regions receiving said screw tips to define a rest position location for said mounting collar relative to said mounting platform and said aperture therethrough.

21. In a vertical window covering system, a window covering material portion having a plurality of sections disposed in a generally vertical orientation, said portion being adaptable to being traversed between open and closed conditions and having inherent distortion characteristics causing non-vertical hanging of left and right edge portions thereof in an open or partially open condition and misalignment out of the plane of traverse when traversing from an open to a closed condition, a traverse track adapted to be mounted in a horizontal orientation; a plurality of track mounting means for mounting a plurality of sections of said window covering material intermediate said left and right edge portions thereof for bidirectional traverse relative to said traverse track; first and second edge carrier means mounted to said traverse track with at least one of said carrier means adapted for bidirectional traverse on said track; edge stabilizer means mounted on each of said carrier means for holding said edge portions of said window covering material in a substantially straight vertical orientation when said material is traversed toward an open condition, including a stabilizer rod means mounted to said carrier means in an accurate vertical orientation and with a degree of rigidity sufficient to overcome said inherent distortion characteristic, said stabilizer rod means extending at least substantially the entire length of an associated one of said edge portions of said window covering material and being secured thereto at least at a plurality of locations throughout said length; and traverse alignment means for maintaining the alignment of said vertical material sections during said traverse toward said closed condition, said traverse alignment means including guide apertures formed in said vertical material sections at a prearranged position near a bottom edge thereof, guide cord means extending through said guide apertures and being fastened to a first one of said stabilizer rod means, and tensioning means operatively mounted to a second one of said stabilizer rod means for maintaining said guide cord in substantial tension throughout the traverse of said material portion between said open and closed conditions.

22. The system of claim 21, wherein said tensioning means comprises a pulley mounted to said stabilizer rod means at a prearranged distance above the bottom end thereof and receiving said guide cord thereover, and a weight mounted on said guide cord for producing said tension therein.

23. The system of claim 22, wherein said stabilizer rod means comprises a housing having at least two vertical wall sections defining an internal cavity, one of said wall sections being disposed perpendicular to said plane of traverse and being adapted to mount one edge portion of said window covering material portion thereto, another of said wall sections defining bracket means within said cavity for carrying said pulley arrangement and channel means providing a vertical channel for confining said weight therein.

24. The system of claim 21, wherein said traverse track defines a pair of carriage tracks; said traversing carrier means comprises a carriage having a plurality of wheels thereon for traversing said carriage tracks and having a bottom wall portion with a mounting bracket thereon defining a horizontal mounting channel extending parallel to said plane of traverse; said edge stabilizer means includes a mounting rod including a horizontally disposed portion received in said mounting channel in rotatable relationship; and attaching means associated with said mounting bracket for fixing the position of said mounting rod within said channel.

25. The system of claim 24, wherein said stabilizer rod means comprises a housing having at least two vertical wall sections defining an internal cavity, a first of said wall sections being disposed perpendicular to said plane of traverse and being adapted to mount one edge portion of said window covering material portion thereto, a second of said wall sections defining an internal vertical channel running the length thereof; a bracket fastened within a top portion of said channel for carrying said mounting rod thereon to mount said stabilizer rod means on said carriage; said tensioning means comprising a pulley mounted on said bracket for carrying said guide cord thereon and a weight fastened on said guide cord and carried in said channel to confine its vertical motion therewithin.

26. The system of claim 25, wherein said second wall section also defines on each end thereof a generally C-shaped groove extending the length of said housing, and further comprising a section of fabric covering an exterior surface of said second wall section and having edge portions received into said C-shaped grooves; and elongated, flexible retainer beads received within said C-shaped grooves to retain said fabric edge portions therewithin.

27. The system of claim 25, wherein said first wall section defines a pair of opposed end grooves thereon, and further comprising a slat of material received received in said end grooves and having an edge portion of said window covering material portion wrapped therearound to fasten said window covering material portion to said housing.

28. The system of claim 27, wherein said first and second wall sections form a triangular shaped internal cavity and the free ends of said first and second wall sections define a pair of opposing grooves, and further comprising a slat of material received in said opposing grooves to enclose said triangular cavity.

29. The system of claim 21, wherein each of said carrier means is adapted for bidirectional traverse, said traverse alignment means further includes a second guide aperture formed in each of said vertical material sections at a second prearranged position separated from said first position, a second guide cord means extending through said second guide apertures and being fastened to said second one of said stabilizer rods, and a second tensioning means operatively mounted to said first one of said stabilizer rods, each of said carrier means further including releasable brake means for holding said carrier means in a preselected position against the forces exerted thereon by respective ones of said first and second tensioning means.

30. The system of claim 24, wherein said stabilizer rod means comprises a main body portion disposed vertically and secured to said edge portions of said window covering material, said mounting rod is an L-shaped rod having a vertical rod portion extending below said horizontal rod portion, and said stabilizer rod means further comprises mounting means for mounting said mounting rod to said main body portion with a rotational detented safety release action in the plane of said window covering material to provide a temporary rotational movement of said main body portion in response to horizontal pushing forces near a bottom region of said main body portion which might otherwise tend to distort said carriage assembly or other components of said system and including spring biasing means for biasing said main body portion to a detented vertical rest position.

31. The system of claim 30, wherein said mounting means comprises a vertical bracket secured to said main body portion of said stabilizer rod means, at least one vertical wall of said bracket extending parallel to the plane of said window covering material and defining at least one safety detent aperture pattern having a first circular region comprising a rest location and a pair of adjacent second circular regions comprising release locations with centers of said circular regions in a generally triangular pattern, said vertical rod portion of said mounting rod having a roller carried thereon and received in said aperture pattern in said wall of said bracket, said bracket further having a horizontal mounting platform below said detent aperture pattern, and compression spring means having one end contacting said mounting platform and another end mounted in biasing relation to said vertical rod portion of said mounting rod to bias said roller into said rest location of said detent aperture pattern, whereby a sideways torque of magnitude above a threshold value determined in part by said spring pressure and said detent aperture pattern exerted on said main body portion is transmitted through said bracket to cause said roller on said vertical rod portion to respond by moving into one of said adjacent circular regions and thereby providing temporary release of said torque with angular movement of said main body portion to a position providing pulling force on said carriage means in the direction of the applied force.

32. The system of claim 31, wherein said vertical bracket has a generally U-shaped cross section with front and back vertical walls each extending parallel to the plane of said window covering material and each defining upper and lower ones of said safety detent aperture pattern, said vertical rod portion of said mounting rod extending between said front and back walls and having upper and lower pairs of rollers mounted thereon, said upper pair of rollers being received in said upper safety detent aperture patterns and said lower pair of rollers being received in said lower safety detent aperture patterns, said horizontal mounting platform extending below said lower safety detent aperture patterns.

* * * * *